US010334961B2

(12) United States Patent
Lin et al.

(10) Patent No.: US 10,334,961 B2
(45) Date of Patent: Jul. 2, 2019

(54) PORTABLE DEVICE FOR CONTROLLING ELECTRICAL ADJUSTABLE APPARATUS

(71) Applicant: TIMOTION TECHNOLOGY CO., LTD., New Taipei (TW)

(72) Inventors: Dong-Jye Lin, New Taipei (TW); Chung-Yi Chen, New Taipei (TW); Chang-Lin Tu, New Taipei (TW); Chi-Hung Chan, New Taipei (TW)

(73) Assignee: TIMOTION TECHNOLOGY CO., LTD., New Taipei (TW)

( * ) Notice: Subject to any disclaimer, the term of this patent is extended or adjusted under 35 U.S.C. 154(b) by 0 days.

(21) Appl. No.: 16/177,208

(22) Filed: Oct. 31, 2018

(65) Prior Publication Data

US 2019/0059607 A1 Feb. 28, 2019

Related U.S. Application Data

(63) Continuation of application No. 15/228,872, filed on Aug. 4, 2016, now Pat. No. 10,154,736.

(30) Foreign Application Priority Data

| | | |
|---|---|---|
| Aug. 24, 2015 | (TW) | 104127571 A |
| Nov. 20, 2015 | (TW) | 104138640 A |
| Jul. 14, 2016 | (TW) | 105122243 A |

(51) Int. Cl.
*A47B 9/00* (2006.01)
*A47C 20/04* (2006.01)
(Continued)

(52) U.S. Cl.
CPC ..... *A47C 31/008* (2013.01); *A47C 7/506* (2013.01); *A47C 20/041* (2013.01); *A47B 9/00* (2013.01); *A47B 2200/0062* (2013.01)

(58) Field of Classification Search
CPC . A47B 2200/0062; A47B 9/00; A47C 20/041; A47C 31/008; A47C 7/506
See application file for complete search history.

(56) References Cited

U.S. PATENT DOCUMENTS 8,926,535 B2 * 1/2015 Rawls-Meehan .... A47C 20/041 601/56
10,154,736 B2 * 12/2018 Lin ..... A47C 31/008
(Continued)

*Primary Examiner* — Abdelmoniem I Elamin
(74) *Attorney, Agent, or Firm* — Chun-Ming Shih; HDLS IPR Services

(57) ABSTRACT

A portable device for controlling an external electrical adjustable apparatus is provided. The portable device has a case, a signal transmitter connected to the electrical adjustable apparatus, a tilt sensor sensing a tilted angle and a controlling operation, a memory storing a threshold angle and a processor. The processor generates a controlling signal according to the controlling operation, and transmitting the controlling signal to an electrical adjustable apparatus for making the electrical adjustable apparatus raise/lower. The processor further determines that the electrical adjustable apparatus has collision when receiving a controlling signal used to control the electrical adjustable apparatus and the tilted angle is not less than the threshold angle, and sends a stopping signal to the electrical adjustable apparatus via the signal transmitter for making the electrical adjustable apparatus stop raising/lowering when determining that the electrical adjustable apparatus has collision.

14 Claims, 16 Drawing Sheets

(51) Int. Cl.
*A47C 31/00* (2006.01)
*A47C 7/50* (2006.01)

(56) References Cited

U.S. PATENT DOCUMENTS

2016/0106205 A1* 4/2016 Hall ..... A47B 9/00
700/275
2016/0170402 A1* 6/2016 Lindstrom ..... A47B 9/00
700/275
2016/0255153 A1* 9/2016 Ayers ..... H04Q 9/00
702/188
2017/0112716 A1* 4/2017 Rawls-Meehan .....
A61H 23/0263

* cited by examiner

PORTABLE DEVICE FOR CONTROLLING ELECTRICAL ADJUSTABLE APPARATUS

CROSS-REFERENCE TO RELATED APPLICATIONS

This application is a continuation application of U.S. application Ser. No. 15/228,872 filed on Aug. 4, 2016, now U.S. Pat. No. 10,154,736. The entire disclosure is incorporated herein by reference.

BACKGROUND OF THE INVENTION

Field of the Invention

The technical field relates to device and more particularly related to portable device for controlling electrical adjustable apparatus.

Description of Related Art

In related art, an electrical adjustable apparatus (such as electrical adjustable table) having the ability to adjust the height of carrying structure (such as desktop) has been provided. The electrical adjustable apparatus comprises at least one actuating structure (such as table leg(s)), and the actuating structure's length can be controlled and adjusted by a motor. A user can adjust the actuating structure's length for raising or lowering a carrying structure of the electrical adjustable apparatus to a suitable height for the user via operating a control interface of the electrical adjustable apparatus However, a situation often occurs that the electrical adjustable apparatus of the related art collides with an obstacle and still continues to stretch/shorten during stretching/shortening because the user is not aware of the obstacle in the raising/lowering path of the carrying structure. Above-mentioned situation may make an article placed on the carrying structure fall from the carrying structure or damage the carrying structure, the motor or the obstacle.

Therefore, there is a need to find out a better and more effective solution to handle such problems.

SUMMARY OF THE INVENTION

The present disclosed example directed to provide a portable device for controlling electrical adjustable apparatus which have ability to automatically detect whether a carrying structure has collision and automatically starts an anti-crash mechanism when collision occurs.

One of the exemplary embodiments, a portable device for controlling an external electrical adjustable apparatus, comprise: a case, a signal transmitter installed in the case and connected to the electrical adjustable apparatus, a tilt sensor sensing a tilted angle and sensing a raising/lowering-controlling operation of moving or rotating the portable device, a memory storing a threshold angle, and a processor installed in the case and electrically connected to the signal transmitter, the tilt sensor and the memory. The processor is configured to generate a raising/lowering-controlling signal according to the raising/lowering-controlling operation, and transmitting the raising/lowering-controlling signal by the signal transmitter to the external electrical adjustable apparatus for making the external electrical adjustable apparatus raise/lower according to the raising/lowering-controlling signal. The processor is configured to determine that a carrying structure of the electrical adjustable apparatus has collision when receiving any raising/lowering-controlling signal used to control the electrical adjustable apparatus and the tilted angle is not less than the threshold angle, and sending a stopping signal to the electrical adjustable apparatus via the signal transmitter for making the electrical adjustable apparatus stop raising/lowering the carrying structure.

This present disclosed example can effectively prevent article placing on the carrying structure from falling and prevent the electrical adjustable apparatus or the obstacle from being damaged by continual stretching/shortening after collision.

Besides, via using the tilt sensor of the external portable device to detect whether the carrying structure has collision, this present disclosed example can make the electrical adjustable apparatus have no need to comprise a built-in tilt sensor and effectively reduce the manufacturing cost of the electrical adjustable apparatus.

BRIEF DESCRIPTION OF DRAWING

The features of the present disclosed example believed to be novel are set forth with particularity in the appended claims. The present disclosed example itself, however, may be best understood by reference to the following detailed description of the present disclosed example, which describes an exemplary embodiment of the present disclosed example, taken in conjunction with the accompanying drawings, in which:

DETAILED DESCRIPTION OF THE INVENTION

In cooperation with attached drawings, the technical contents and detailed description of the present invention are described thereinafter according to a preferable embodiment, being not used to limit its executing scope. Any equivalent variation and modification made according to appended claims is all covered by the claims claimed by the present invention.

For clearly describing the technology content of the present disclosed example, the following description explain the technology content of the present disclosed example mainly via taking the electrical adjustable apparatus being an electrical adjustable table for example, but this specific example is not intended to limit the scope of the present disclosed example. The people skilled in the art of the present disclosed example can arbitrarily apply the portable device and the control method or an electrical adjustable apparatus to any type of electrical adjustable apparatus (such as an electrical adjustable wall mount, an electrical adjustable cabinet, an electrical adjustable chair or an electrical adjustable bed) according to the people's requirement.

Figure 1A:
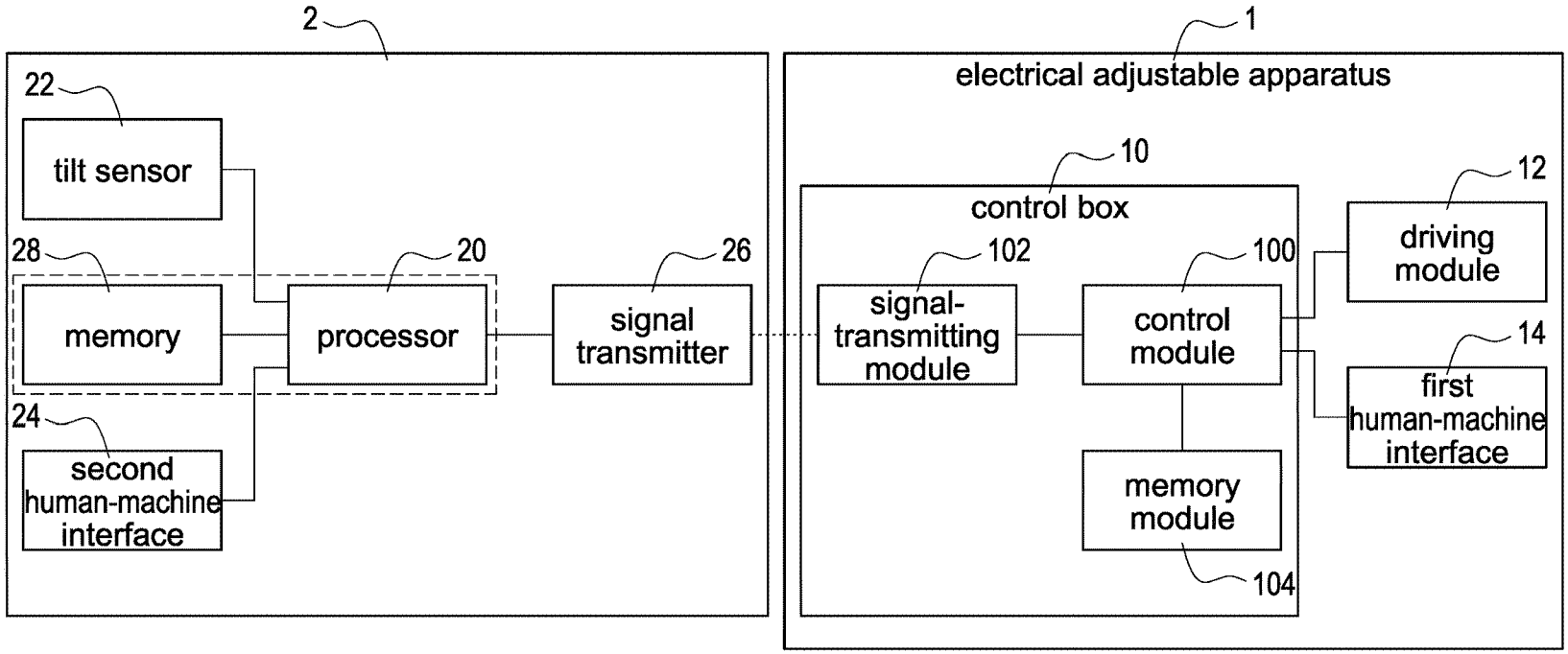
FIG. 1A is an architecture diagram of an electrical adjustable apparatus and a portable device according to a first embodiment of the present disclosed example.
Figure 1B:
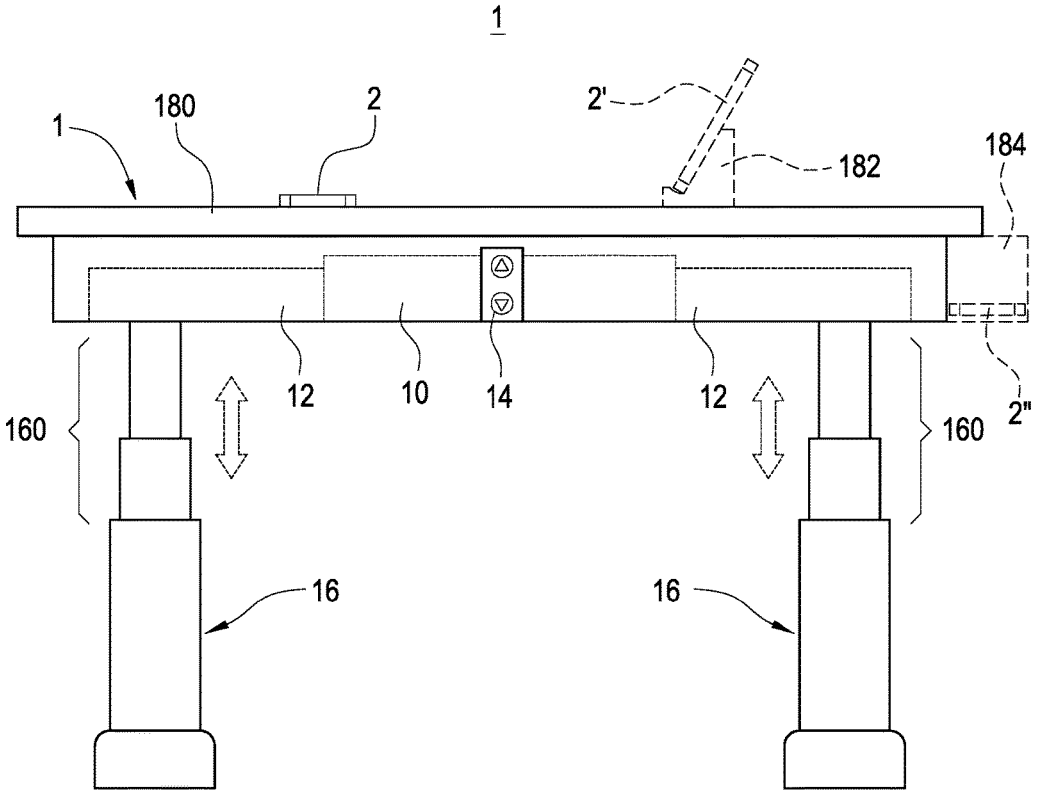
FIG. 1B is a schematic view of an electrical adjustable apparatus and a portable device according to a first embodiment of the present disclosed example.

First, please simultaneously refer to FIG. 1A and FIG. 1B, FIG. 1A illustrates an architecture diagram of an electrical adjustable apparatus and a portable device according to a first embodiment of the present disclosed example, FIG. 1B illustrates a schematic view of an electrical adjustable apparatus and a portable device according to a first embodiment of the present disclosed example.

As shown in figures, this present disclosed example discloses a portable device 2 having an ability of interacting with an external electrical adjustable apparatus 1. More specifically, when the portable device 2 fixes or rests on a carrying structure 180 (In this embodiment, the carrying structure 180 is a desktop) of the electrical adjustable apparatus 1 and is performing a stretching/shortening operation, the electrical adjustable apparatus 1 can achieve a collision-detecting function via a tilt sensor 22 of the portable device 2, and automatically start an anti-crash mechanism when detecting collision. Preferably, the portable device 2 is smart phone, tablet or wearable device (such as smart watch, smart glasses, smart wristband or smart ring) which is held by a user and comprises the built-in tilt sensor 22, but this specific example is not intended to limit the scope of the present disclosed example.

Following description will explain a main architecture of the electrical adjustable apparatus 1. The electrical adjustable apparatus 1 may comprise a control box 10, at least one driving module(s) 12, a first human-machine interface 14 and at least one actuating structure 16 (In this embodiment, the actuating structure 16 is table leg(s)), wherein the actuating structure 16 is adjustable and connected to the carrying structure 180 for supporting and gearing the carrying structure 180, the actuating structure 16 is driven to stretch/shorten by the driving module 12.

The driving module 12 can adjust the length of the actuating structure 16. More specifically, the driving module 12 comprises a motor (not shown in figures), the actuating structure 16 comprises a stretching/shortening structure 160 connected to the motor and controlled by the motor. When the motor operates, the motor can gear a plurality of driving elements (such as gears which are not shown in figures) of the driving module 12, so as to make the stretching/shortening structure 160 (such as an adjustable rod structure) stretch (in other words, increase the length of the actuating structure 16 to uplift the carrying structure 180) or shorten (in other words, reduce the length of the actuating structure 16 to lower the carrying structure 180).

The first human-machine interface 14 (such as touch-screen or buttons) is used to sense a raising/lowering-controlling operation from the user, and triggers a raising/lowering-controlling signal corresponding to the sensed raising/lowering-controlling operation.

The control box 10 comprises a signal-transmitting module 102, a memory module 104 and control module 100 electrically connected to above-mentioned elements, the driving module 12 and the first human-machine interface 14.

The signal-transmitting module 102 is used to transmit signal to outside. Preferably, the signal-transmitting module 102 is wireless transmitting module (such as Wi-Fi transmitting module, Bluetooth transmitting module, ZigBee transmitting module, infrared transmitting module or NFC transmitting module) or wired transmitting module (such as USB transmitting module or UART transmitting module), but this specific example is not intended to limit the scope of the present disclosed example.

The memory module 104 is used to store data. The control module 100 is used to control the electrical adjustable apparatus 1. Besides, the control module 100 can receive the raising/lowering-controlling signal from the first human-machine interface 14 or receive another raising/lowering-controlling signal from outside via the signal-transmitting module 102, and control the driving module 12 to adjust the length of the actuating structure 16 according to the received raising/lowering-controlling signal.

Please be noted that this embodiment takes the electrical adjustable apparatus 1 comprising two actuating structures 16 (in other words, a pair of table legs) for example, but this specific example is not intended to limit the scope of the present disclosed example, the number of the actuating structure 16 can be arbitrarily modified according to the user's request.

Following description will explain a main architecture of the portable device 2. The portable device 2 may comprise the tilt sensor 22, a signal transmitter 26, a memory 28 and a processor 20 electrically connected to above-mentioned elements.

The tilt sensor 22 is mainly used to sense a current tile angle of the body of the portable device 2. Preferably, the tilt sensor 22 is gyroscope, electronic compass, accelerometer or electronic level meter, but this specific example is not intended to limit the scope of the present disclosed example.

The signal transmitter 26 is used to communicate with external device(s). Preferably, the signal transmitter 26 is wireless transmitter (such as Wi-Fi transmitter, Bluetooth transmitter, ZigBee transmitter, infrared transmitter or NFC transmitter) or wired transmitter (such as USB transmitter or UART transmitter), but this specific example is not intended to limit the scope of the present disclosed example. The processor 20 is used to control the portable device 2.

Preferably, the portable device 2 further comprises a case which covers the elements of the portable device 2 for providing protection.

Preferably, the portable device 2 further comprises a second human-machine interface 24 electrically connected to the processor 20 and a memory 28. The second human-machine interface 24 is used to sense operation(s) from the user, and triggers the corresponded raising/lowering-controlling signal. As a storage media, the memory 28 has ability of leading the user to selectively access external information or file(s). The second human-machine interface 24 is touchscreen, buttons, touch panel or trigger(s), but this specific example is not intended to limit the scope of the present disclosed example.

Preferably, the processor 20 and the memory 28 can be integrated into the same module (such as SoC (System on Chip), the same CPU or the CPU comprising the built-in memory 28), but this specific example is not intended to limit the scope of the present disclosed example, the processor 20 and the memory 28 can also be separately arranged in different devices.

In another embodiment of the present disclosed example, the present disclosed example performs collision detection using the portable device 2. More specifically, in this embodiment the electrical adjustable apparatus 1 can be a non-intelligent electrical adjustable apparatus, such as the electrical adjustable apparatus 1 which only has ability of receiving the external manual control operation and doesn't have ability of automatically stretching/shortening. The portable device 2 can perform above-mentioned collision detection after receiving the raising/lowering-controlling signal, send a control signal (such as stopping control signal) to the external electrical adjustable apparatus 1 when detecting collision, so as to perform the anti-crash mechanism via controlling the electrical adjustable apparatus 1 to stop stretching/shortening. Thus, the user can upgrade the existing electrical adjustable apparatus to an intelligent electrical adjustable apparatus having the collision-detecting function and the anti-crash mechanism via only purchasing the portable device. The present disclosed example can effectively reduce the cost of upgrading.

Preferably, the portable device 2 is connected to the electrical adjustable apparatus 1 via a transmitting cable. When the electrical adjustable apparatus 1 is starting to stretch/shorten, the electrical adjustable apparatus 1 can send the raising/lowering-controlling signal (such as the raising/lowering-controlling signal triggered by the first human-machine interface 14) to the portable device 2 via the transmitting cable. The portable device 2 starts to perform collision detection when receiving the raising/lowering-controlling signal from the electrical adjustable apparatus 1.

In another embodiment of the present disclosed example, the portable device 2 sends the raising/lowering-controlling signal to the electrical adjustable apparatus 1 and simultaneously starts to perform collision detection when receiving the raising/lowering-controlling signal triggered by the second human-machine interface 24.

Figure 2:
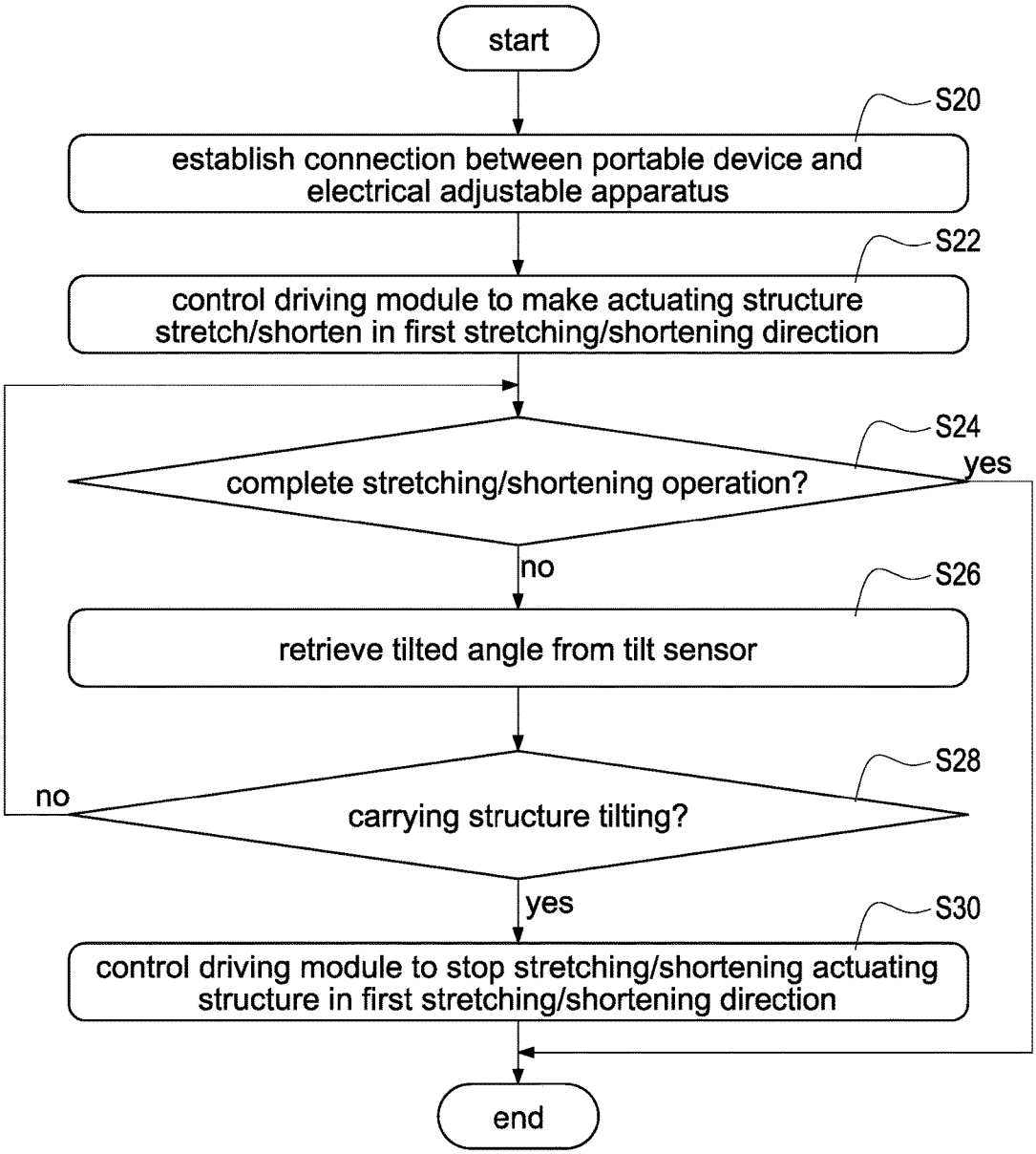
FIG. 2 is a flowchart of a control method for an electrical adjustable apparatus according to a first embodiment of the present disclosed example.

Please refer to FIG. 2, which illustrates a flowchart of a control method for an electrical adjustable apparatus according to a first embodiment of the present disclosed example. More specifically, the memory module 104 of the electrical adjustable apparatus 1 stores a first computer program (not shown in figures). The memory 28 of the portable device 2 stores a second computer program (not shown in figures). When the control module 100 executes the first computer program and the processor 20 executes the second computer program, the electrical adjustable apparatus 1 and the portable device 2 can cooperatively perform following steps used to implement the collision-detecting function and the anti-crash mechanism.

Please be noted that the following description takes the portable device 2 as subject term for explain, such as "the portable device 2 retrieves", "the portable device 2 senses" or "the portable device 2 determines" and so forth, but the one having ordinary skill in the art of the present disclosed example should know that the portable device 2 is controlled by the second computer program to perform those operation after executing the second computer program in implementation.

Step S20: make the external portable device (2, 2', 2', 80, 82, 84, 86, 90, 1000, 1100) and the electrical adjustable apparatus (1) establish a connection. More specifically, the portable device 2 can send a connecting request to the electrical adjustable apparatus (1) via the signal transmitter 26 for asking to establish the connection, or the electrical adjustable apparatus (1) can send the connecting request to the signal transmitter 26 of the portable device 2 via the signal-transmitting module 102 for asking to establish the connection. Preferably, the connection can be wireless connection (such as Bluetooth wireless connection, Wi-Fi wireless connection, ZigBee wireless connection, infrared wireless connection or NFC wireless connection) or wired connection (such as USB wired connection or UART wired connection), but this specific example is not intended to limit the scope of the present disclosed example.

Step S22: control the driving module 12 of the electrical adjustable apparatus 1 to make the actuating structure 16 of the electrical adjustable apparatus 1 stretch/shorten in a first stretching/shortening direction (such as stretching up). More specifically, the electrical adjustable apparatus 1 can control the driving module 12 to perform above-mentioned stretching/shortening operation according to the raising/lowering-controlling signal received from the first human-machine interface 14 or the portable device 2.

Please be noted that for implementing the collision-detecting function, during the electrical adjustable apparatus 1 being stretching/shortening, the portable device 2 must simultaneously fix or rest on the carrying structure 180 for making the subsequently retrieved tilted angle be a true reflection of a current tilted status of the carrying structure 180.

Preferably, the portable device 2 can fix or rest on any position of the carrying structure 180 in any placing angle. For example, the portable device 2 can be pasted or placed parallel with the carrying structure 180 (such as the portable device 2 placed parallel on the desktop shown in FIG. 1B), obliquely placed on a support pedestals 182 upon the carrying structure 180 (as the portable device 2' shown in FIG. 1B), or placed in an accommodating space 184 of the carrying structure 180 (as the portable device 2" shown in FIG. 1B, the accommodating space 184 is drawer or groove, but this specific example is not intended to limit the scope of the present disclosed example).

Step S24: the electrical adjustable apparatus 1 or the portable device 2 determines whether the stretching/shortening operation completes. Preferably, the portable device 2 can sense whether the carrying structure 180 is stretching/shortening for determining whether the stretching/shortening operation completes via the tilt sensor 22 (such as determining according to the sensed continuous time acceleration variation, angular acceleration variation, magnetic inclination variation or induced voltage variation), communicating with the electrical adjustable apparatus 1 (such as determining by knowing whether the portable device 2 receives an operation-completing signal) or determining whether a stretching/shortening time elapses. If the stretching/shortening operation doesn't complete, the portable device 2 performs the step S26. Otherwise, the portable device 2 terminates the method.

Step S26: the portable device 2 retrieves the current tilted angle from the tilt sensor 22.

Preferably, the portable device 2 retrieves a current sensing value from the tilt sensor 22, such as angular acceleration (if the tilt sensor 22 is gyroscope), triaxial acceleration (if the tilt sensor is triaxal accelerometer), magnetic inclination (if the tilt sensor 22 is electronic compass) or induced voltage (if the tilt sensor 22 is electronic level meter), and calculates the tilted angle accord to the sensing value.

In another embodiment of the present disclosed example, the portable device 2 can retrieve the current tilted angle from the tilt sensor 22 as an initial angle before the above-mentioned stretching/shortening operation starting. Then, during performing above-mentioned stretching/shortening operation, the portable device 2 can calculate the actual tilted angle according to the initial angle and the current tilted angle. For instance, if the initial angle is 60 degrees (such as the handhold portable device 2' is placed on the support pedestals 182 having a 60 degrees support portion), the sensed current tilted angle is 61 degrees, and the actual calculated tile angle is 1 degree.

Thus, even the portable device 2 isn't placed parallel with the carrying structure 180 (the initial angle is not equal to 0 degree), the present disclosed example still can retrieve the correct tile angle.

Step S28: determine whether the carrying structure 180 tilts. More specifically, the portable device 2 can determine whether the carrying structure 180 tilts according to retrieved tilted angle.

Preferably, the portable device 2 determines that the carrying structure 180 tilts and has collision when the tilted angle is not less than a threshold angle (such as 0.3 degrees), and sends a stopping signal to the electrical adjustable apparatus 1 via the signal connection for performing the anti-crash mechanism.

Alternatively, the portable device 2 calculates a tilted speed according to the tilted angle, and determines that the carrying structure 180 tilts and has collision when the tilted speed changed.

Please be noted that when the carrying structure 180 has collision (such as colliding with the obstacle during stretching/shortening the actuating structure 16), both the carrying structure 180 and the portable device 2 placed on the carrying structure 180 will tilt and change speed. As a result, this present disclosed example can effectively implement the collision-detecting function via determining whether the carrying structure 180 tilts and has collision according to the tilted angle (or the tilted speed) calculated by the portable device 2.

If the electrical adjustable apparatus 1 and the portable device 2 determine that the carrying structure 180 tilts, the electrical adjustable apparatus 1 and the portable device 2 perform a step S30 for performing the anti-crash mechanism. Otherwise, the electrical adjustable apparatus 1 and the portable device 2 perform the step S24 again.

Step S30: the electrical adjustable apparatus 1 controls driving module 12 to stop stretching/shortening actuating structure 16 in the first stretching/shortening direction. More specifically, after receiving the stopping signal, the electrical adjustable apparatus 1 forcibly controls driving module 12 to make the actuating structure 16 stop above-mentioned stretching/shortening operation for preventing the carrying structure 180 from being damaged by continual stretching/shortening after collision.

Furthermore, after the actuating structure 16 stopping stretching/shortening in the first stretching/shortening direction, the electrical adjustable apparatus 1 can further control the driving module 12 to make the actuating structure 16 stretch/shorten a second stretching/shortening distance in a second stretching/shortening direction, which is opposite to the first stretching/shortening direction (such as shortening 5 cm down) for separating the carrying structure 180 with obstacle.

Please be noted that this embodiment takes retrieving the current tilted angle from the tilt sensor 22 during stretching/shortening the actuating structure for example, but the timing of retrieving the tilted angle is not intended to limit the scope of the present disclosed example. In another embodiment of the present disclosed example, the electrical adjustable apparatus 1 or the portable device 2 continually retrieves the current tilted angle from the tilt sensor 22 for determining whether the carrying structure 180 tilts or the portable device 2 receives the raising/lowering-controlling operation (described later) after the wireless connection or the wired connection between the electrical adjustable apparatus 1 and the portable device 2 is established.

Please be noted that the steps S24-S28 are performed by the portable device 2 in this embodiment, but this specific example is not intended to limit the scope of the present disclosed example. In another embodiment of the present disclosed example, the steps S24-S28 are performed by the electrical adjustable apparatus 1.

More specifically, in the step S24, the electrical adjustable apparatus 1 can determine whether the stretching/shortening completes via monitoring the driving module 12.

In the step S26, the electrical adjustable apparatus 1 retrieves the tilted angle from the portable device 2 via the signal connection. In other words, like an external tilt sensor, the portable device 2 only sends the retrieved tilted angle to the electrical adjustable apparatus 1, and doesn't perform any determination or process to the tilted angle (in other words, don't determining whether the carrying structure has collision according to the tilted angle).

In the step S28, the electrical adjustable apparatus 1 determines whether the carrying structure 180 tilts according to the tilted angle received from the portable device 2, determines that the carrying structure 180 has collision when determining that the carrying structure 180 tilts, and sends the stopping signal to the driving module 12 to stopping stretching/shortening the actuating structure 16 for performing the anti-crash mechanism.

Figure 3A:
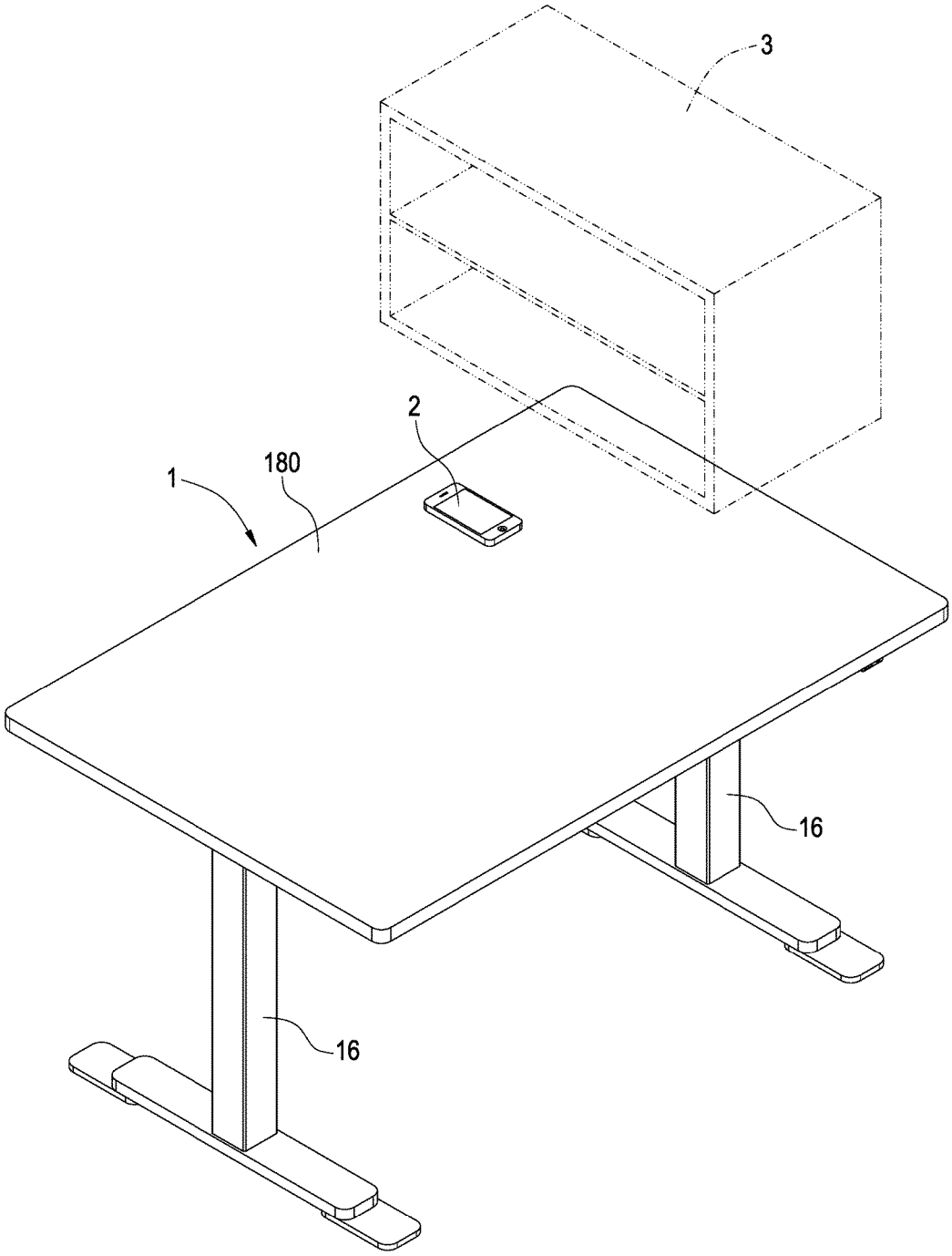
FIG. 3A is a first schematic view of raising/lowering an electrical adjustable apparatus according to a first embodiment of the present disclosed example.
Figure 3B:
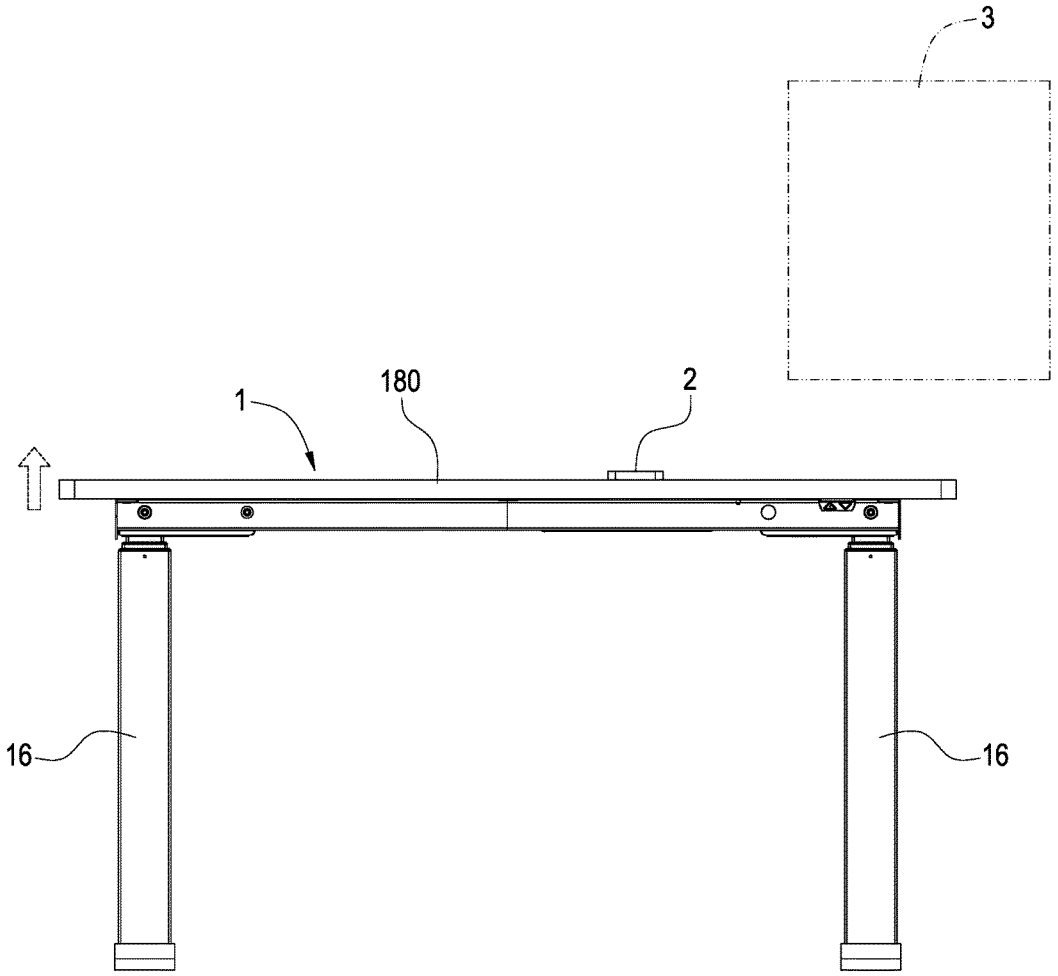
FIG. 3B is a second schematic view of raising/lowering an electrical adjustable apparatus according to a first embodiment of the present disclosed example.
Figure 3C:
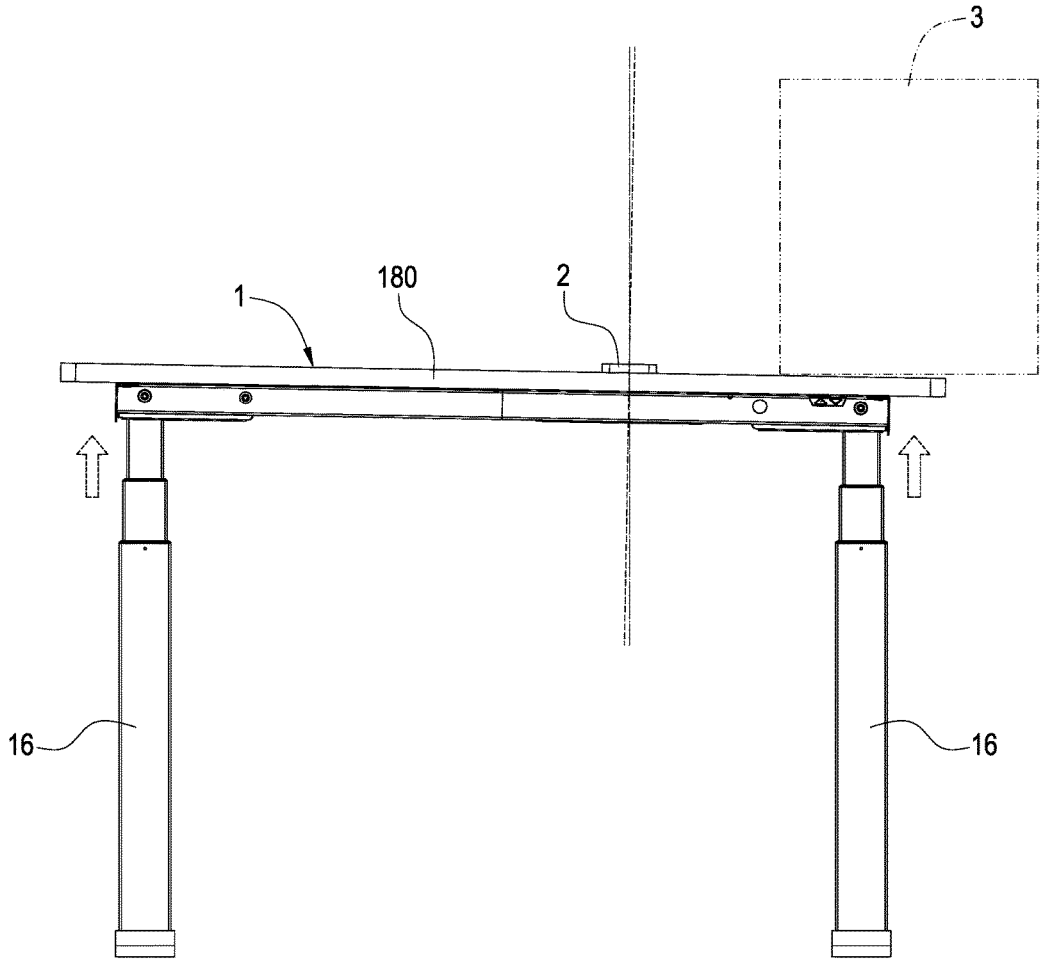
FIG. 3C is a third schematic view of raising/lowering an electrical adjustable apparatus according to a first embodiment of the present disclosed example.

Please simultaneously refer to FIG. 1A-3C, FIG. 3A illustrates a first schematic view of raising/lowering an electrical adjustable apparatus according to a first embodiment of the present disclosed example, FIG. 3B illustrates a second schematic view of raising/lowering an electrical adjustable apparatus according to a first embodiment of the present disclosed example, FIG. 3C illustrates a third schematic view of raising/lowering an electrical adjustable apparatus according to a first embodiment of the present disclosed example, above-mentioned figures are used to exemplary explain how the control method of this present disclosed example implements the collision-detecting function and performs the anti-crash mechanism.

In this example, the electrical adjustable apparatus 1 is an electrical adjustable table and arranged under a cupboard 3. As shown in FIG. 3A, when the electrical adjustable apparatus 1 is horizontal, the carrying structure 180 is in a horizontal status and is not in contact with the cupboard 3. Besides, the user can operate the portable device 2 built-in with the tilt sensor 22 to connect the electrical adjustable apparatus 1, and place the connection-completed portable device 2 on the stationary carrying structure 180 as the external tilt sensor of the electrical adjustable apparatus 1.

Then, as shown in FIG. 3B, the user can control the electrical adjustable apparatus 1 to stretch the actuating structures 16 (take table legs for example) for uplifting the carrying structure 180 (take table desktop for example) to a suitable height via the first human-machine interface 14 or the second human-machine interface 24. Besides, during stretching the actuating structures 16, the electrical adjustable apparatus 1 can continually retrieve the tilted angle from the portable device 2 for determining whether the carrying structure 180 has collision.

Then, as shown in FIG. 3C, the carrying structure 180 changes from the horizontal status to the tilted status when continuing to uplift and colliding the upper cupboard 3, and this makes the portable device 2 placed on the carrying structure 180 become tilted. In the same time, the tilted angle retrieved by the portable device 2 will become different (such the tilted angle becoming 1 degree from 0 degree). Thus, the portable device 2 can determine that the carrying structure 180 has collision and sends the stopping signal to the electrical adjustable apparatus 1 for making the electrical adjustable apparatus 1 perform the anti-crash mechanism (stopping stretching actuating structures 16). Besides, after the electrical adjustable apparatus 1 stops stretching the actuating structures 16, the electrical adjustable apparatus 1 can further shorten the actuating structures 16 to lower the carrying structure 180 until receiving another stopping signal from the portable device 2, wherein the portable device 2 sends the second-time stopping signal to the electrical adjustable apparatus 1 when determining that the retrieved tilted angle comes back to normal status (in other words, the carrying structure 180 becoming horizontal status). Thus, this present disclosed example can prevent the carrying structure 180 and the cupboard 3 from being damaged by collision and continuous extrusion.

Figure 4:
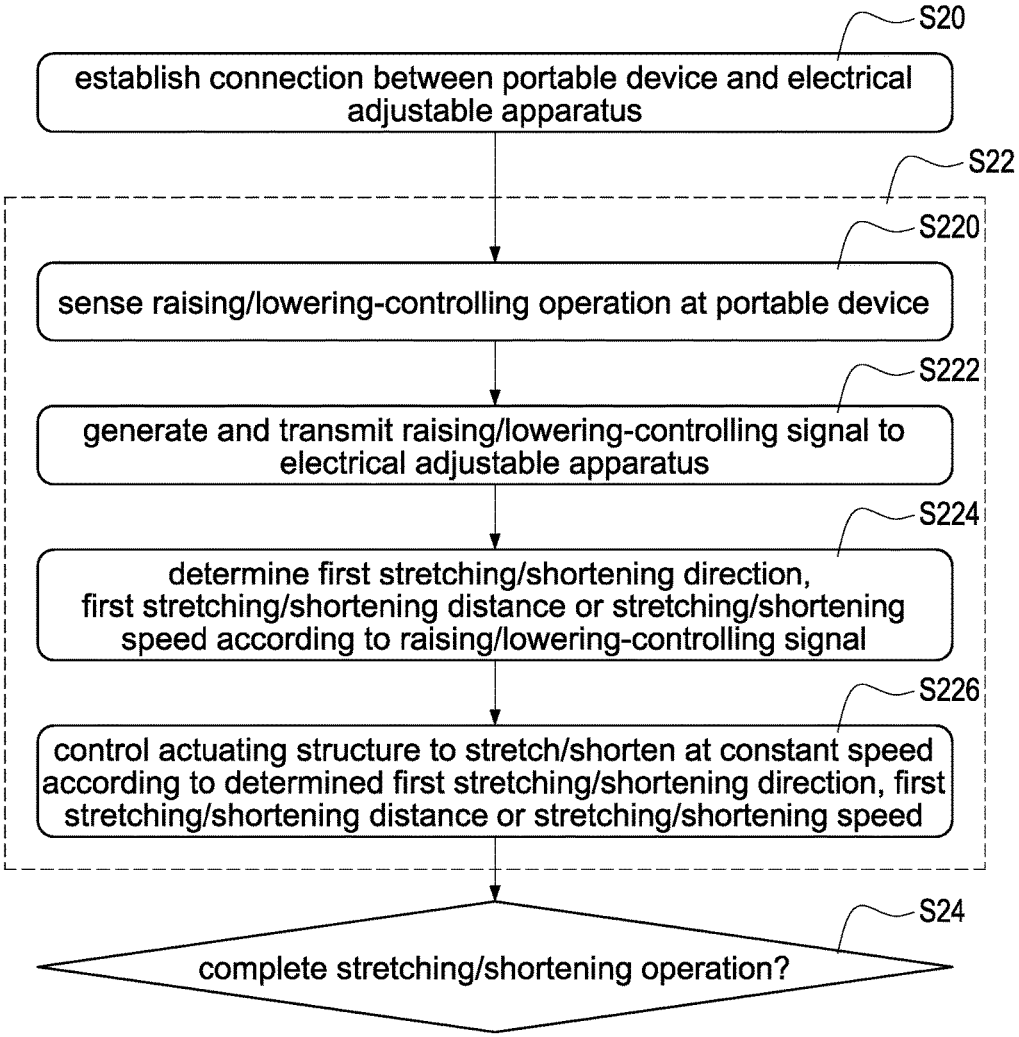
FIG. 4 is a flowchart of a control method for an electrical adjustable apparatus according to a first embodiment of the present disclosed example.

Please refer to FIG. 4, which illustrates a flowchart of a control method for an electrical adjustable apparatus according to a first embodiment of the present disclosed example. In this embodiment, the step S22 further comprises following steps.

Step S220: the portable device 2 receives the raising/lowering-controlling operation. Preferably, the portable device 2 can display a graphical user interface (GUI) on the second human-machine interface 24 after executing the second computer program, and sense the raising/lowering-controlling operation via the GUI.

Figure 5A:
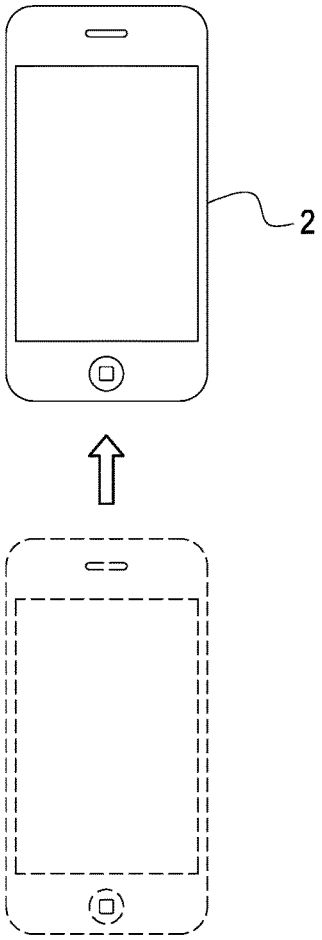
FIG. 5A is a first schematic view of a raising/lowering-controlling operation according to a first embodiment of the present disclosed example.
Figure 5B:
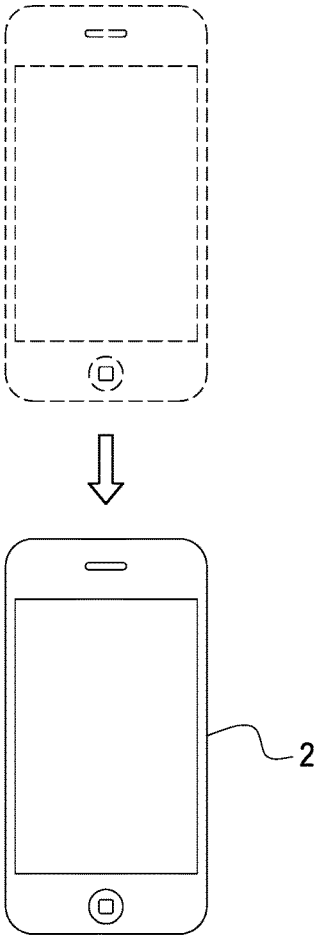
FIG. 5B is a second schematic view of a raising/lowering-controlling operation according to a first embodiment of the present disclosed example.
Figure 5E:
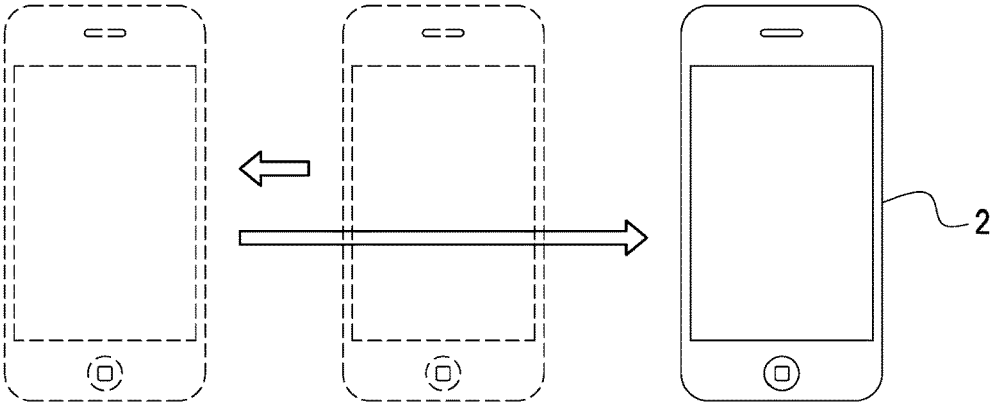
FIG. 5E is a schematic view of a control-preceding operation according to a first embodiment of the disclosed example.
Figure 5C:
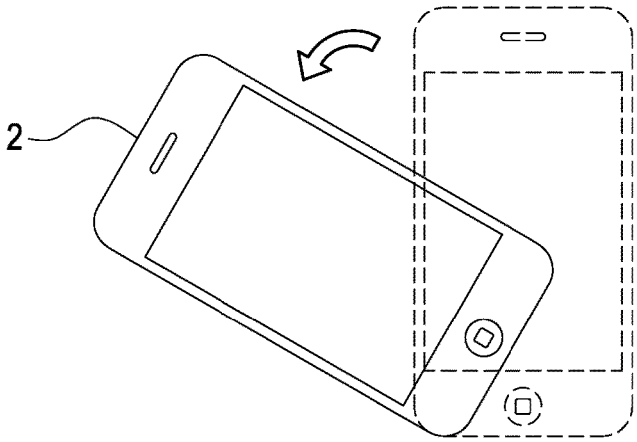
FIG. 5C is a third schematic view of a raising/lowering-controlling operation according to a first embodiment of the present disclosed example.
Figure 5D:
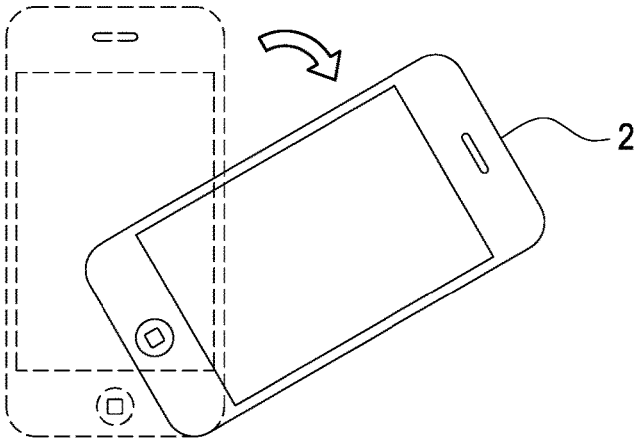
FIG. 5D is a forth schematic view of a raising/lowering-controlling operation according to a first embodiment of the present disclosed example.

Please simultaneously refer to FIG. 5A-5D, FIG. 5A illustrates a first schematic view of a raising/lowering-controlling operation according to a first embodiment of the present disclosed example, FIG. 5B illustrates a second schematic view of a raising/lowering-controlling operation according to a first embodiment of the present disclosed example, FIG. 5C illustrates a third schematic view of a raising/lowering-controlling operation according to a first embodiment of the present disclosed example, FIG. 5D illustrates a forth schematic view of a raising/lowering-controlling operation according to a first embodiment of the present disclosed example.

In another embodiment of the present disclosed example, the portable device 2 senses the raising/lowering-controlling operation via the tilt sensor 22. More specifically, the portable device 2 can sense the raising/lowering-controlling operation via the tilt sensor 22 after executing the second computer program. Preferably, the raising/lowering-controlling operation is the operation of horizontally moving or rotating the portable device 2 on the carrying structure 180.

For example, as shown in FIG. 5A, the user can move the portable device 2 in a first horizontal moving direction (taking moving upward for example) for inputting the raising/lowering-controlling operation (referred to the first raising/lowering-controlling operation in following description). Or, as shown in FIG. 5B, the user can move the portable device 2 in a second horizontal moving direction (taking moving down for example), which is opposite to the first horizontal moving direction, for inputting the raising/lowering-controlling operation (referred to the second raising/lowering-controlling operation in following description). Or, as shown in FIG. 5C, the user can horizontally rotate the portable device 2 in a first rotating direction (taking rotating counterclockwise for example) for inputting the raising/lowering-controlling operation (referred to the third raising/lowering-controlling operation in following description). Or, as shown in FIG. 5D, the user can horizontally rotate the portable device 2 in a second rotating direction (taking rotating clockwise for example), which is opposite to the first rotating direction, for inputting the raising/lowering-controlling operation (referred to the forth raising/lowering-controlling operation in following description).

Please be noted that the first raising/lowering-controlling operation and the second raising/lowering-controlling operation can respectively correspond to two related function (such as stretching the actuating structure 16 and shortening the actuating structure 16). The third raising/lowering-controlling operation and the forth raising/lowering-controlling operation can respectively correspond to another two related function (such as increasing a stretching/shortening speed and reducing the stretching/shortening speed). This present disclosed example can effectively improve user experience via providing a more intuitive way to input.

In another embodiment of the present disclosed example, this present disclosed example further provides an erroneous-input-proof function. More specifically, the user must input a control-preceding operation before inputting the raising/lowering-controlling operation for making the portable device 2 recognize that the current sensed raising/lowering-controlling operation inputted by the user is not the erroneous input. Preferably, the control-preceding operation can be an operation of pressing the specific button (such as power button) of the portable device 2, touching the specific position of the touchscreen of the portable device 2 down, inputting a password, unlocking a screen lock of the portable device 2 or moving the portable device 2 in a specific way, but this specific example is not intended to limit the scope of the present disclosed example.

Please simultaneously refer to FIG. 5E, which illustrates a schematic view of a control-preceding operation according to a first embodiment of the present disclosed example this figure is used to exemplarily explain the control-preceding operation. This example takes the control-preceding operation being moving the portable device 2 in a specific way for example. More specifically, before inputting the raising/lowering-controlling operation, the user can first horizontally moving the portable device 2 in a first operating direction (taking moving leftward for example), then horizontally moves the portable device 2 in a second operating direction (taking moving rightward for example) to input the control-preceding operation.

Preferably, the portable device 2 determines the current sensed operation only based on the direction without referring to the moving distance, moving starting point or moving endpoint. Thus, this present disclosed example can provide a more intuitive way to input.

Step S222: the portable device 2 generates the raising/lowering-controlling signal corresponding to the sensed raising/lowering-controlling operation, and sends the generated raising/lowering-controlling signal to the electrical adjustable apparatus 1 via the signal connection.

Preferably, the user or a provider of the second computer program can configure the raising/lowering-controlling operation prior to input for making the different raising/lowering-controlling operations respectively corresponding to the different raising/lowering-controlling signals. Thus, the portable device 2 can generate the corresponded raising/lowering-controlling signal after recognizing the sensed raising/lowering-controlling operation, and send to the electrical adjustable apparatus 1.

For example, the first raising/lowering-controlling operation can be corresponded to the raising/lowering-controlling signal used to control the actuating structure 16 to stretch, the second raising/lowering-controlling operation can be corresponded to the raising/lowering-controlling signal used to control the actuating structure 16 to shorten, the third raising/lowering-controlling operation can be corresponded to the raising/lowering-controlling signal used to control the actuating structure 16 to reduce the stretching/shortening speed, and the forth raising/lowering-controlling operation can be corresponded to the raising/lowering-controlling signal used to control the actuating structure 16 to increase the stretching/shortening speed.

Preferably, the user or the provider of the second computer program can further configure a predefined control-preceding operation, the portable device 2 receives the raising/lowering-controlling operation and generates the corresponded raising/lowering-controlling signal after determining that the sensed control-preceding operation consists with the predefined control-preceding operation. Thus, this present disclosed example can effectively prevent the user from erroneously inputting.

Step S224: the electrical adjustable apparatus 1 determines the first stretching/shortening direction (such as stretching upward or shortening down), a first stretching/shortening distance or the stretching/shortening speed according to the received raising/lowering-controlling signal. Besides, the electrical adjustable apparatus 1 can further determine the first stretching/shortening direction, the first stretching/shortening distance or the stretching/shortening speed having not been determined according to a predefined stretching/shortening direction (such as the current stretching/shortening direction), a predefined stretching/shortening distance (such as 10 cm) or a predefined stretching/shortening speed (such as 5 cm per second).

For example, if the raising/lowering-controlling signal is a "stretching upward" signal, the electrical adjustable apparatus 1 can determine that the first stretching/shortening direction is a "stretching upward" direction, set the predefined stretching/shortening distance (such as 10 cm) as the first stretching/shortening distance, and set the predefined stretching/shortening distance as the stretching/shortening distance. Thus, the electrical adjustable apparatus 1 can obtain all stretching/shortening parameters by itself for effectively controlling the actuating structure 16 to stretch/shorten in the following steps even the raising/lowering-controlling signal only comprises a part of stretching/shortening parameters.

In another example, if the raising/lowering-controlling signal is a "stretching/shortening-speed-up" signal, the electrical adjustable apparatus 1 can increase the predefined stretching/shortening speed or the stretching/shortening speed by 1 unit (for example, each unit is 2 cm per second) according to the "stretching/shortening-speed-up" raising/lowering-controlling signal, and set the predefined stretching/shortening distance (such as 10 cm) as the stretching/shortening distance.

Step S226: the electrical adjustable apparatus 1 controls the driving module 12 to make the actuating structure 16 stretch/shorten at constant speed according to the determined stretching/shortening speed, the first stretching/shortening direction or the first stretching/shortening distance. More specifically, the electrical adjustable apparatus 1 controls the driving module 12 to make the actuating structure 16 stretch/shorten the first stretching/shortening distance at the constant stretching/shortening speed.

Please be noted that this present disclosed example further provides a real-time control function. More specifically, during the actuating structure 16 stretching/shortening (such as the selection "no" in the step S24), the portable device 2 can sense the raising/lowering-controlling operation inputted by the user, generate and send the corresponded raising/lowering-controlling signal to the electrical adjustable apparatus 1 for making the electrical adjustable apparatus 1 real-time adjust the status of the actuating structure 16 stretching/shortening (such as real-time changing the first stretching/shortening direction, the first stretching/shortening distance or the stretching/shortening speed) according to the received raising/lowering-controlling signal.

For example, during the actuating structure 16 stretching/shortening, if the portable device 2 senses the raising/lowering-controlling operation of "reducing the stretching/shortening speed", the portable device 2 can generate and send the corresponded raising/lowering-controlling operation to the electrical adjustable apparatus 1 for make the electrical adjustable apparatus lreal-time reduce the current stretching/shortening speed (such as changing from 5 cm per second to 2.5 cm per second). Thus, the user can real-time control the electrical adjustable apparatus 1 to stretch/shorten more precisely.

This present disclosed example can effectively prevent article placing on the carrying structure from falling and prevent the electrical adjustable apparatus or the obstacle from being damaged by the continual stretching/shortening of the carrying structure even after colliding with the obstacle.

Besides, via using the tilt sensor of the external portable device to detect whether the carrying structure has collision, this present disclosed example can make the electrical adjustable apparatus to dispense with a built-in tilt sensor and effectively reduce the manufacturing cost of the electrical adjustable apparatus.

Figure 6:
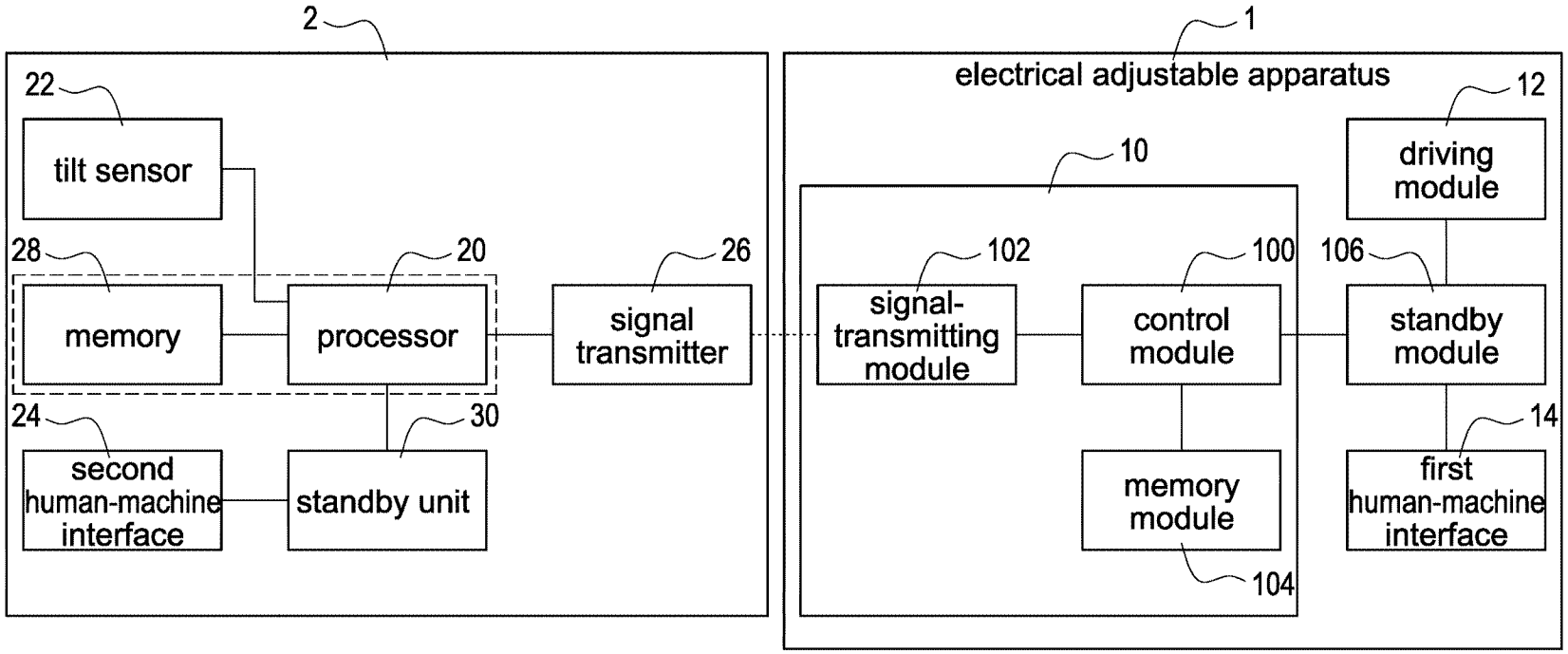
FIG. 6 is an architecture diagram of an electrical adjustable apparatus and a portable device according to a second embodiment of the present disclosed example.

Please refer to FIG. 6, which illustrates an architecture diagram of an electrical adjustable apparatus and a portable device according to a second embodiment of the present disclosed example. Each element of the electrical adjustable apparatus 1 and the portable device 2 of this embodiment is the same or similar as the above-mentioned first embodiment, the relevant description is omitted for brevity. In comparison to the first embodiment, the portable device 2 of this embodiment further comprises a standby unit 30.

Besides, in this embodiment, the standby unit 30 is electrically connected to the second human-machine interface 24 and the processor 20. More specifically, after the second human-machine interface 24 receives the operation from the user, the second human-machine interface 24 can trigger and send the corresponded raising/lowering-controlling signal (called the initial raising/lowering-controlling signal) to the standby unit 30 for triggering the standby unit to be conductive. Then, the standby unit 30 can forward the received raising/lowering-controlling signal to the processor 20. The processor 20 sends the initial raising/lowering-controlling signal to the electrical adjustable apparatus 1. Preferably, the standby unit 30 is an optical coupler continually keeping conductive via continuous triggering by the raising/lowering-controlling signal, but this specific example is not intended to limit the scope of the present disclosed example.

Besides, after sending the initial raising/lowering-controlling signal, the processor 20 can generate a standby signal to the standby unit 30 for making the standby unit 30 keep conductive for a standby time (such as 10 seconds) for making the portable device 2 switching to a standby status. In other words, when the second human-machine interface 24 fails to outputting the raising/lowering-controlling signal caused by the user stopping inputting operation, the standby unit 30 can keep the human-machine interface 24 and the processor 20 conductive for the standby time (in other words, the human-machine interface 24 and the processor 20 can still send signal each other in the period of the standby time).

Besides, when the second human-machine interface 24 receives the operation from the user again in the period of the standby time, because the path between the human-machine interface 24 and the processor 20 is still conductive, the second human-machine interface 24 can immediately send the corresponded raising/lowering-controlling signal (called the second-time raising/lowering-controlling signal) to the processor 20 such that the electrical adjustable apparatus 1 can immediately perform the corresponded operation according to the received second-time raising/lowering-controlling signal without needing restart.

Please be noted that the portable device 2 can shut down the standby unit 30 for exiting from the standby status (such as switching to a shut-down status or a sleeping status) when the standby time elapses. Preferably, the processor 20 continually generates and sends the standby signal to the standby unit 30 in the period of the standby time for making the standby unit 30 keep conductive. Besides, after the processor 20 determining that the standby time elapses, the processor 20 stops sending the standby signal to the standby unit 30 for making the standby unit 30 shut down.

This present disclosed example can effectively reduce the response time during which the portable device operates again after receiving the second-time operation from the user via keeping the standby unit of the portable device conductive for a period of time after signal-disconnecting. Besides, this present disclosed example can effectively prevent the portable device 2 from continually keeping the standby status and wasting electronic power via making the portable device automatically exit the standby status after the standby time elapses.

Although the standby unit 30 is installed in the portable device 2 in this embodiment, but this specific example is not intended to limit the scope of the present disclosed example. In another embodiment of the present disclosed example, the standby unit can be installed in the electrical adjustable apparatus 1 (such as the standby module 106 shown in the FIG. 6), the standby module 106 is the same or similar as the standby unit 30, and the relevant description is omitted for brevity. Preferably, the standby module 106 can be electrically connected to the control module 100, the driving module 12 and the first human-machine interface 14, and determine that the path between the three is conductive or disconnected. The standby module 106 can forward the control signal sent from the control module 100 to the driving module 12, or forward the control signal sent from the first human-machine interface 14 to the control module 100. Then, the standby module 106 can operate as above-mentioned standby unit 30 for providing a standby function.

Figure 7:
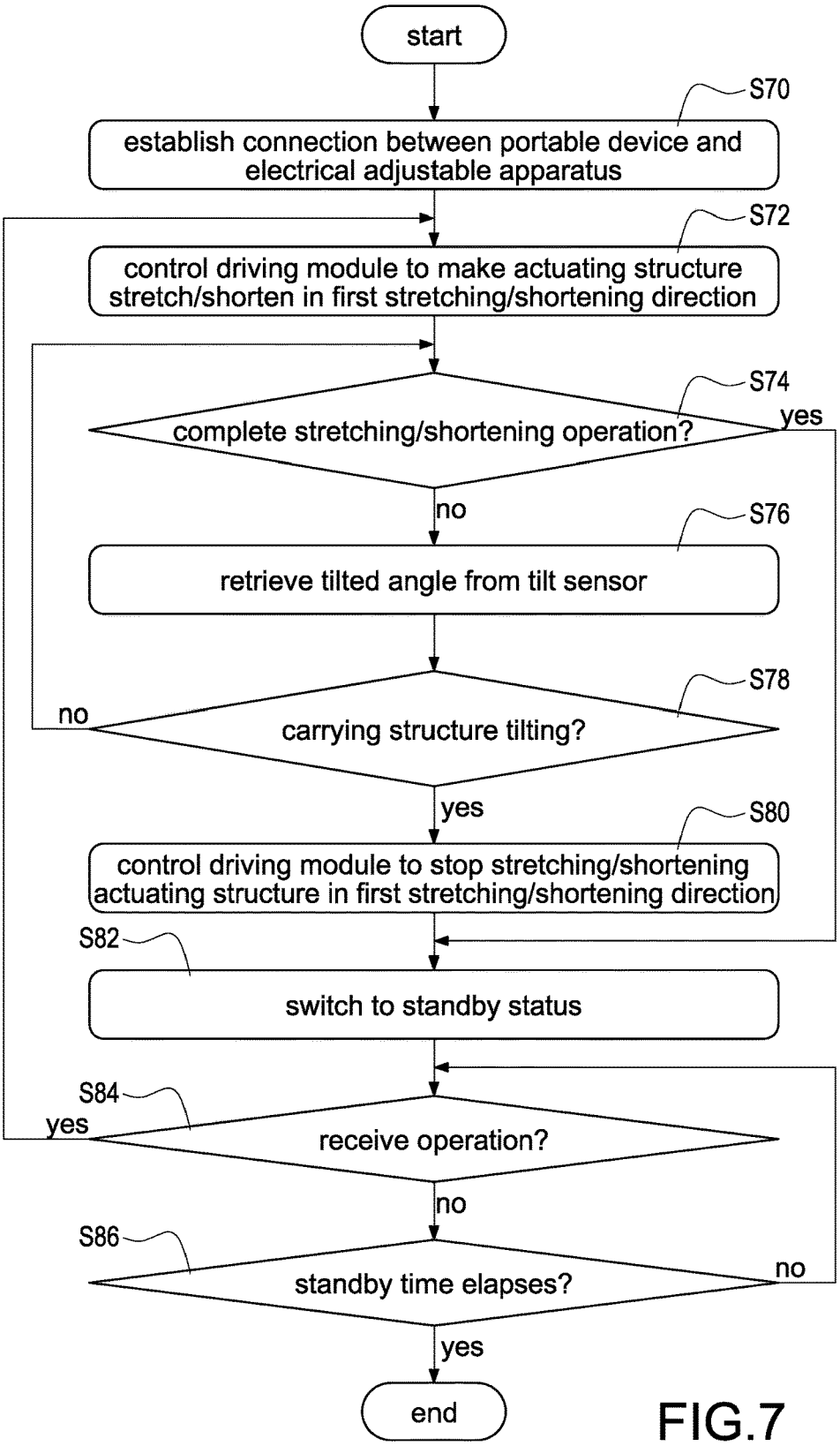
FIG. 7 is a flowchart of a control method for an electrical adjustable apparatus according to a second embodiment of the present disclosed example.

Please refer to FIG. 7, which illustrates a flowchart of a control method for an electrical adjustable apparatus according to a second embodiment of the present disclosed example. The control method for an electrical adjustable apparatus in this embodiment is mainly implemented by the electrical adjustable apparatus 1 and the portable device 2 as illustrated in FIG. 6. The steps S70-S80 of the control method for an electrical adjustable apparatus in this embodiment are the same or similar as the steps S20-S30 of the control method for an electrical adjustable apparatus in the first embodiment, the relevant description is omitted for brevity. The difference between this embodiment and the first embodiment is that this embodiment further comprises following steps.

Step S82: switch to the standby status. More specifically, when the actuating structure 16 stops stretching/shortening (such as the electrical adjustable apparatus 1 stopping caused by the stretching/shortening height consists with a height which the user expects, or the carrying structure 180 of the electrical adjustable apparatus 1 stopping caused by the anti-crash mechanism starting up), the electrical adjustable apparatus 1 or the portable device 2 can automatically switch to the standby status (such as sending the standby signal to the standby unit 30 or the standby module 106 for making them continually keep conductive).

Step S84: determine whether it receives the user operation. More specifically, the control module 100 of the electrical adjustable apparatus 1 can determine whether the electrical adjustable apparatus 1 or the portable device 2 has received the operation from the user by knowing whether the electrical adjustable apparatus 1 has received the raising/lowering-controlling signal (celled the second-time raising/lowering-controlling signal) from the first human-machine interface 14 or from the portable device 2 via the signal-transmitting module 102, and send the received raising/lowering-controlling signal via the conductive standby module 106 to the driving module 12 when determining that the operation inputted by the user has been received.

Or, the second human-machine interface 24 of the portable device 2 can sense whether the second human-machine interface 24 has received the operation from the user, then generate and send the corresponded raising/lowering-controlling signal to the processor 20 via the conductive standby unit 30 when receiving the operation from the user.

If sensing that the operation inputted by the user has been received, the electrical adjustable apparatus 1 or the portable device 2 performs the step S72 for stretching/shortening the actuating structure 16 again. Otherwise, the electrical adjustable apparatus 1 or the portable device 2 performs the step S86.

Step S86: determine whether the standby time elapses. If the standby time didn't elapse, the electrical adjustable apparatus 1 or the portable device 2 performs the step S84 again. Otherwise, the electrical adjustable apparatus 1 or the portable device 2 terminates the control method for an electrical adjustable apparatus.

Preferably, the control module 100 can determine whether the standby time elapses, and disable the standby module 106 (such as sending a disable signal or stopping sending the standby signal) when the standby time elapses for making the electrical adjustable apparatus 1 switching to the shut-down status or the sleeping status.

Or, the processor 20 also can determine whether the standby time elapses, and disable the standby unit 30 (such as sending a disable signal or stopping sending the standby signal) for making the portable device 2 switching to the shut-down status or the sleeping status.

Via making the portable device or the electrical adjustable apparatus automatically switch to the standby status, the present disclosed example can effectively reduce a required respondent time of executing the second-time operation, and enhance the convenience. Besides, via making the portable device or the electrical adjustable apparatus automatically exit the standby status for saving power consumption after the standby time elapses, the present disclosed example can effectively prevent from continually keeping the standby status and wasting electronic power.

Figure 8A:
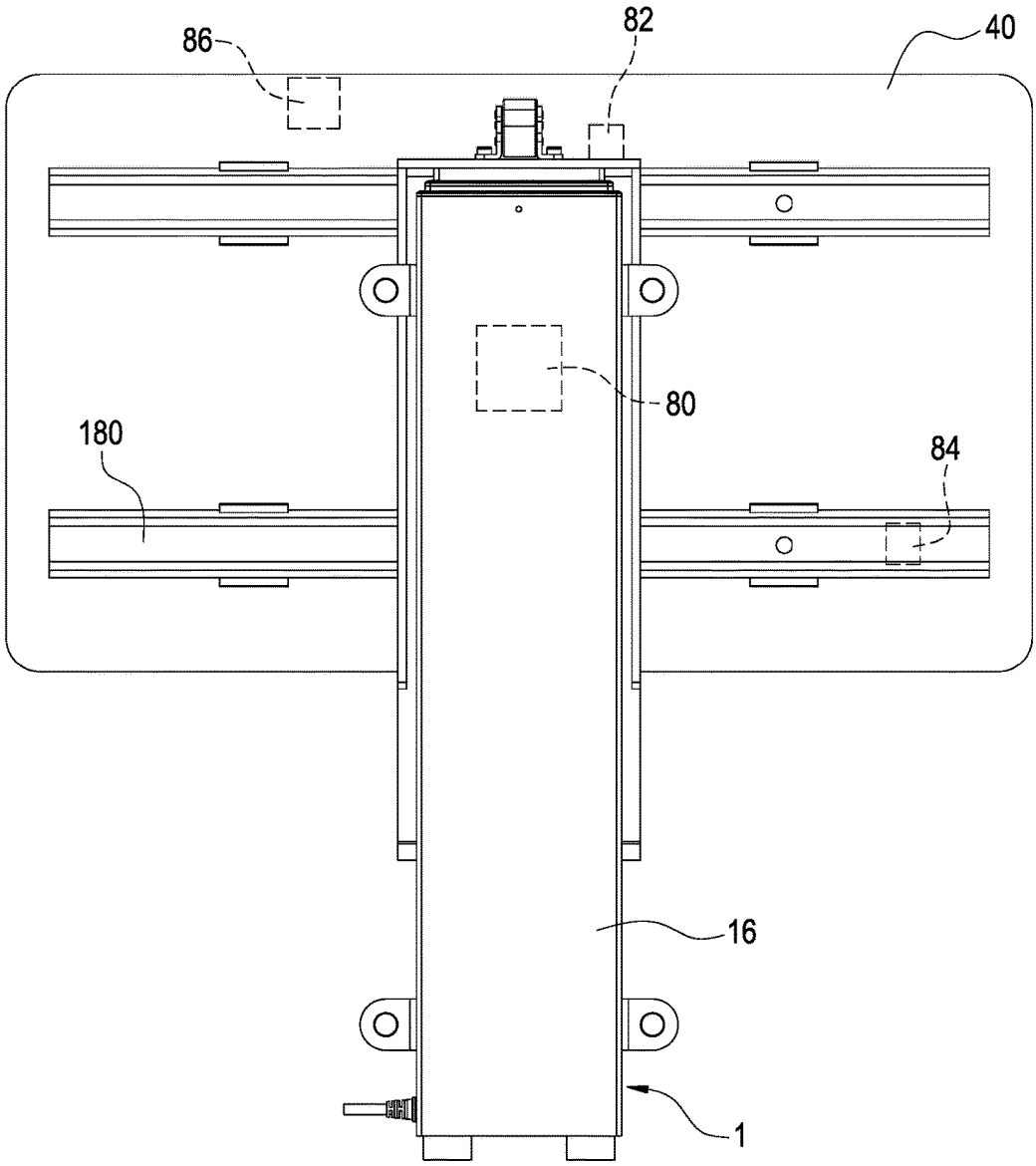
FIG. 8A is a first schematic view of an electrical adjustable apparatus and a portable device according to a fourth embodiment of the present disclosed example.
Figure 8B:
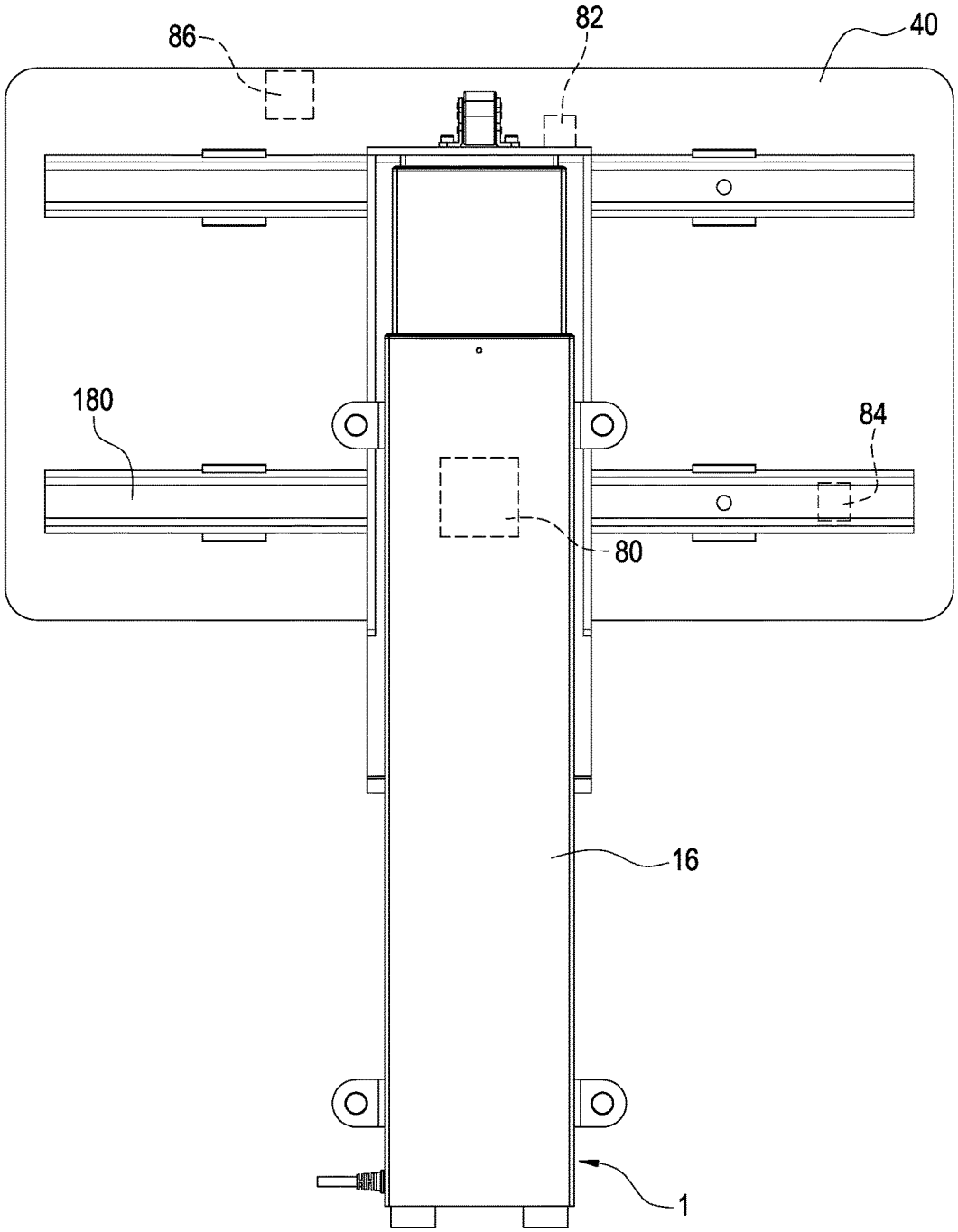
FIG. 8B is a second schematic view of an electrical adjustable apparatus and a portable device according to a fourth embodiment of the present disclosed example.

Please refer to FIG. 8A and FIG. 8B, FIG. 8A illustrates a first schematic view of an electrical adjustable apparatus and a portable device according to a fourth embodiment of the present disclosed example, FIG. 8B illustrates a second schematic view of an electrical adjustable apparatus and a portable device according to a fourth embodiment of the present disclosed example. The portable device 80, 82, 84, 86 of this embodiments are corresponding to above-mentioned portable device 2, the relevant description is omitted for brevity. As shown in FIG. 8A, in this embodiment, the electrical adjustable apparatus 1 is electrical adjustable wall mount, the actuating structure 16 is a liftable pillar, and the carrying structure 180 is a TV support bracket and used to support a TV 40. The portable device can be installed on the actuating structure 16 of the electrical adjustable apparatus 1 (such as the place of the portable device 80), the top of the electrical adjustable apparatus 1 (such as the place of the portable device 82), the carrying structure 180 (such as the place of the portable device 84) or the TV 40 (such as the place of the portable device 86). Preferably, the portable device 80, 82, 84, 86 is installed on the electrical adjustable apparatus 1 or the TV 40 in a pasting manner or a component-fixing manner (such as fixing by using screw(s) or latch structure).

Additionally, when the electrical adjustable apparatus 1 is in a stationary status, the carrying structure 180 is in a horizontal status. Besides, the user can operate the portable device 80, 82, 84, 86 built-in with the tilt sensor 22 to establish a connection with the electrical adjustable apparatus 1, and install the connected portable device 80, 82, 84, 86 on the electrical adjustable apparatus 1 or the TV 40 such that the portable device 80, 82, 84, 86 may function as an external collision sensor of the electrical adjustable apparatus 1.

Then, as shown in FIG. 8B, the user can control the electrical adjustable apparatus 1 to stretch the actuating structure 16 for raising the carrying structure 180 to an appropriate height via the first human-machine interface 14 or the second human-machine interface 24. Besides, during stretching the actuating structure 16, the electrical adjustable apparatus 1 can continually retrieve the tilted angle or acceleration from the portable device 80, 82, 84, 86 via the established connection for determining whether the carrying structure 180 tilts or has collision, and automatically perform the anti-crash mechanism when determining that the carrying structure 180 tilts or has collision.

Figure 9A:
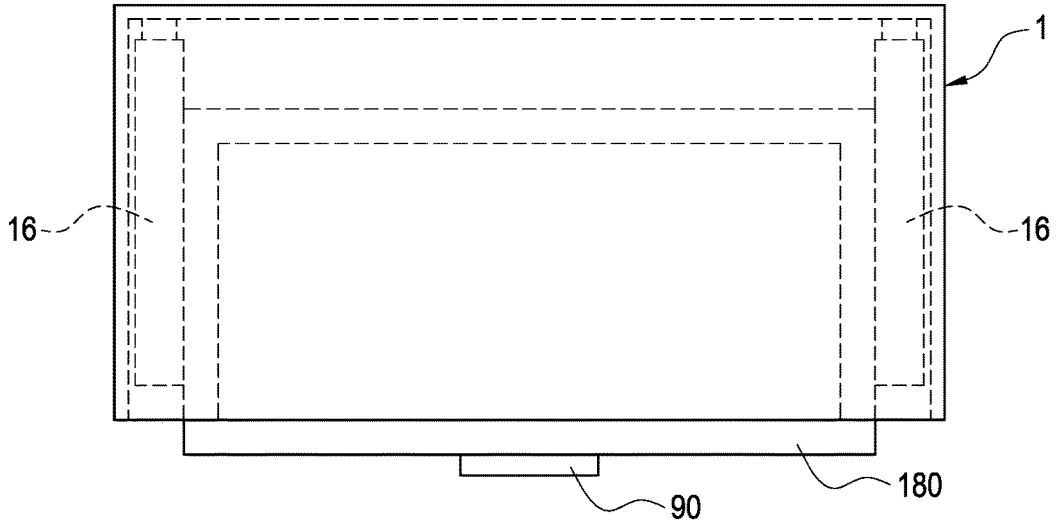
FIG. 9A is a first schematic view of an electrical adjustable apparatus and a portable device according to a fifth embodiment of the present disclosed example.
Figure 9B:
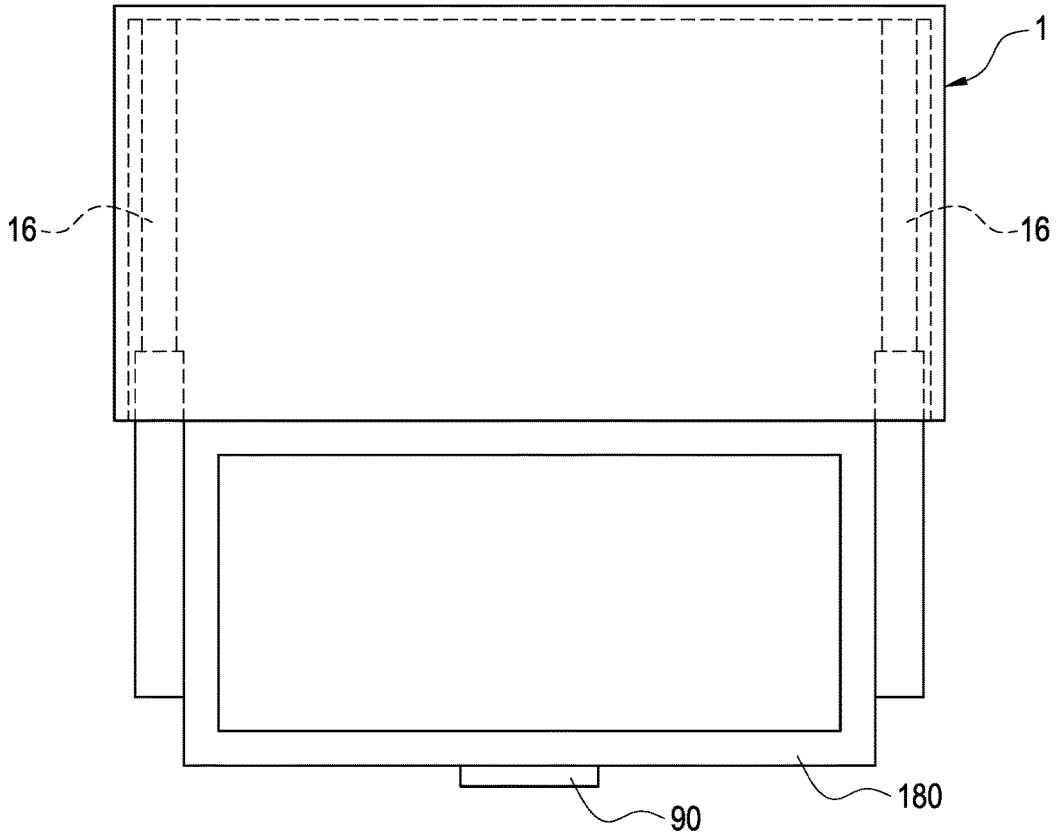
FIG. 9B is a second schematic view of an electrical adjustable apparatus and a portable device according to a fifth embodiment of the present disclosed example.

Please refer to FIG. 9A and FIG. 9B, FIG. 9A illustrates a first schematic view of an electrical adjustable apparatus and a portable device according to a fifth embodiment of the present disclosed example, FIG. 9B illustrates a second schematic view of an electrical adjustable apparatus and a portable device according to a fifth embodiment of the present disclosed example. The portable device 90 of this embodiment is corresponding to above-mentioned portable device 2; the relevant description is omitted for brevity.

As shown in FIG. 9A, in this embodiment, the electrical adjustable apparatus 1 is electrical adjustable cabinet, the actuating structure 16 is a liftable pillar, and the carrying structure 180 is a liftable cabinet. The portable device can be installed on the carrying structure 180 (such as the place of the portable device 90). Preferably, the portable device 90 is installed on the electrical adjustable apparatus 1 in a pasting manner or a component-fixing manner.

Additionally, when the electrical adjustable apparatus 1 is in a stationary status, the carrying structure 180 is in a horizontal status. Besides, the user can operate the portable device 90 built-in with the tilt sensor 22 to establish a connection with the electrical adjustable apparatus 1, and install the connected portable device 90 on the electrical adjustable apparatus 1 such that the portable device 90 may function as an external collision sensor of the electrical adjustable apparatus 1.

Then, as shown in FIG. 9B, the user can control the electrical adjustable apparatus 1 to stretch the actuating structure 16 for lowering the carrying structure 180 to an appropriate height via the first human-machine interface 14 or the second human-machine interface 24. Besides, during stretching the actuating structure 16, the electrical adjustable apparatus 1 can continually retrieve the tilted angle or acceleration from the portable device 90 for determining whether the carrying structure 180 tilts or has collision, and automatically perform the anti-crash mechanism when determining that the carrying structure 180 tilts or has collision.

Figure 10A:
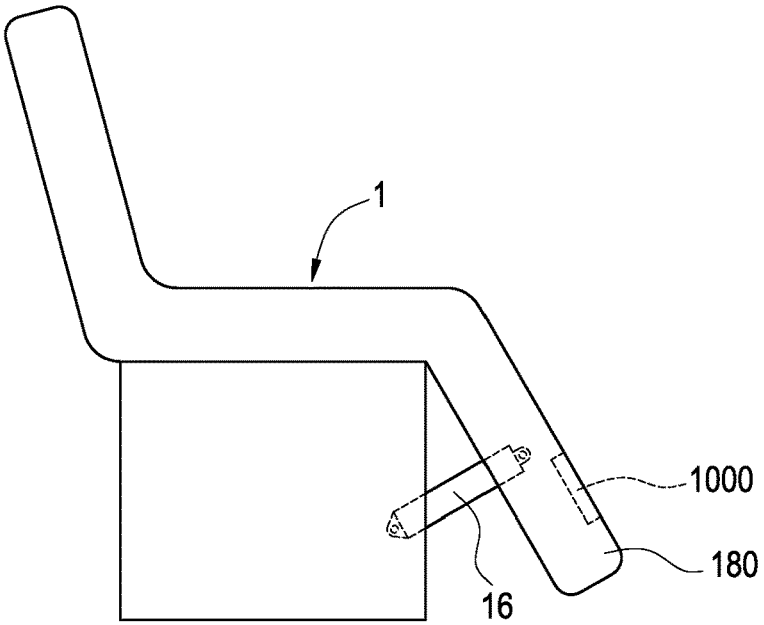
FIG. 10A is a first schematic view of an electrical adjustable apparatus and a portable device according to a sixth embodiment of the present disclosed example.
Figure 10B:
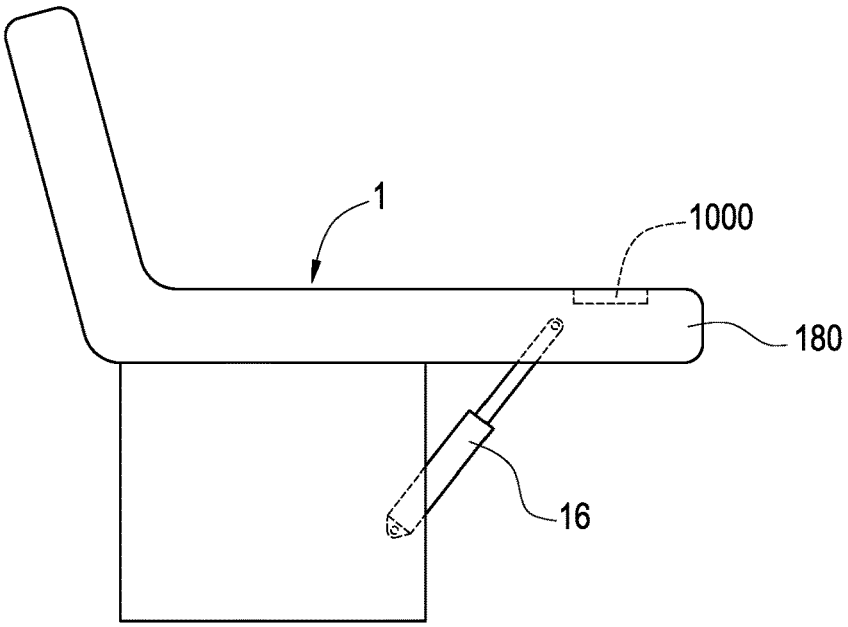
FIG. 10B is a second schematic view of an electrical adjustable apparatus and a portable device according to a sixth embodiment of the present disclosed example.

Please refer to FIG. 10A and FIG. 10B, FIG. 10A illustrates a first schematic view of an electrical adjustable apparatus and a portable device according to a sixth embodiment of the present disclosed example, FIG. 10B illustrates a second schematic view of an electrical adjustable apparatus and a portable device according to a sixth embodiment of the present disclosed example. The portable device 1000 of this embodiment is corresponding to above-mentioned portable device 2; the relevant description is omitted for brevity.

As shown in FIG. 10A, in this embodiment, the electrical adjustable apparatus 1 is electrical adjustable chair, the actuating structure 16 is a liftable pillar, and the carrying structure 180 is an adjustable leg-support cushion. The portable device can be installed on the carrying structure 180 (such as the place of the portable device 1000). Preferably, the portable device 1000 is installed on the electrical adjustable apparatus 1 in a pasting manner or a component-fixing manner. Additionally, when the electrical adjustable apparatus 1 is in a stationary status, the tilted angle of the carrying structure 180 keeps a fixed value. Besides, the user can operate the portable device 1000 built-in with the tilt sensor 22 to establish a connection with the electrical adjustable apparatus 1, and install the connected portable device 1000 on the electrical adjustable apparatus 1 such that the portable device 1000 may function as an external collision sensor of the electrical adjustable apparatus 1.

Then, as shown in FIG. 10B, the user can control the electrical adjustable apparatus 1 to stretch the actuating structure 16 for raising the carrying structure 180 to an appropriate height via the first human-machine interface 14 or the second human-machine interface 24. Besides, during raising the carrying structure 180, the electrical adjustable apparatus 1 can continually retrieve the tilted angle or acceleration from the portable device 1000 for determining whether the carrying structure 180 tilts or has collision, and automatically perform the anti-crash mechanism when determining that the carrying structure 180 tilts or has collision.

Figure 11A:
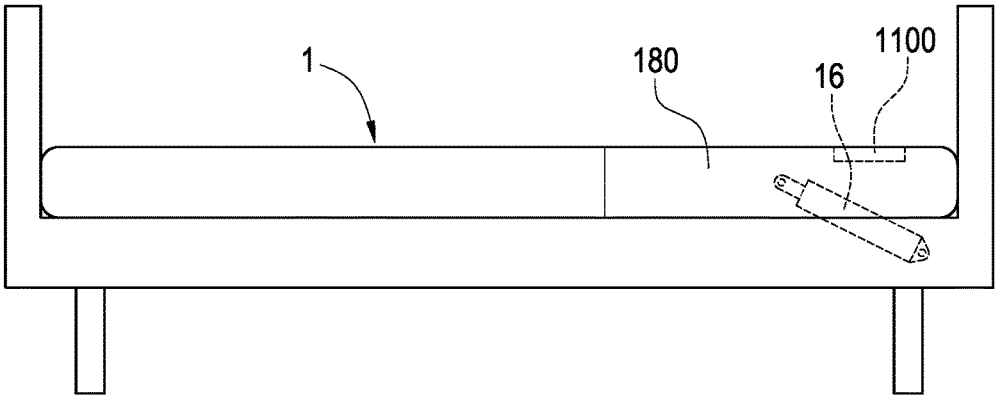
FIG. 11A is a first schematic view of an electrical adjustable apparatus and a portable device according to a seventh embodiment of the present disclosed example.
Figure 11B:
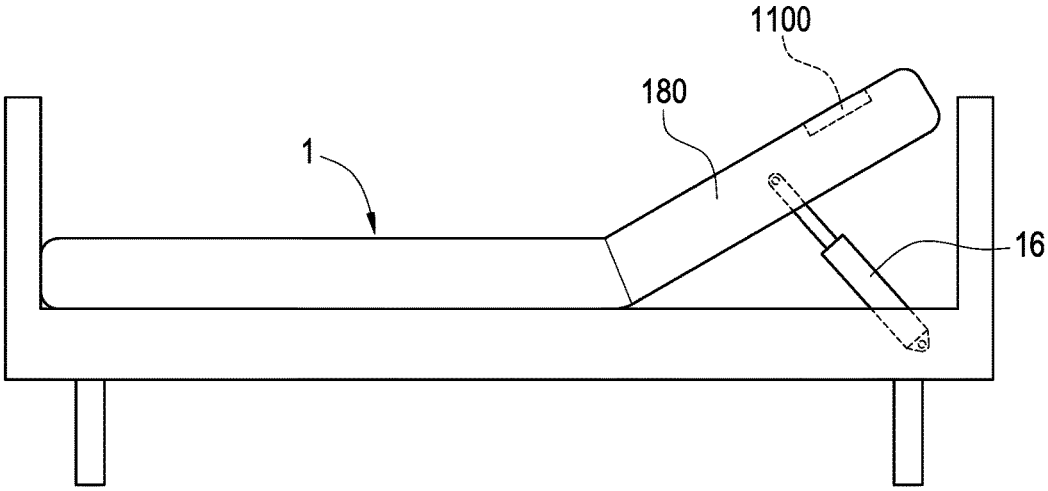
FIG. 11B is a second schematic view of an electrical adjustable apparatus and a portable device according to a seventh embodiment of the present disclosed example.

Please refer to FIG. 11A and FIG. 11B, FIG. 11A illustrates a first schematic view of an electrical adjustable apparatus and a portable device according to a seventh embodiment of the present disclosed example, FIG. 11B illustrates a second schematic view of an electrical adjustable apparatus and a portable device according to a seventh embodiment of the present disclosed example. The portable device 1100 of this embodiment is corresponding to above-mentioned portable device 2; the relevant description is omitted for brevity.

As shown in FIG. 11A, in this embodiment, the electrical adjustable apparatus 1 is electrical adjustable bed, the actuating structure 16 is a liftable pillar, and the carrying structure 180 is an adjustable head support cushion. The portable device can be installed on the carrying structure 180 (such as the place of the portable device 1100). Preferably, the portable device 1000 is installed on the electrical adjustable apparatus 1 in a pasting manner or a component-fixing manner.

Additionally, when the electrical adjustable apparatus 1 is in a stationary status, the tilted angle of the carrying structure 180 keeps a fixed value. Besides, the user can operate the portable device 1100 built-in with the tilt sensor 22 to establish a connection with the electrical adjustable apparatus 1, and install the connected portable device 1100 on the electrical adjustable apparatus 1 such that the portable device 1100 may function as an external collision sensor of the electrical adjustable apparatus 1.

Then, as shown in FIG. 11B, the user can control the electrical adjustable apparatus 1 to stretch the actuating structure 16 for raising the carrying structure 180 to an appropriate height via the first human-machine interface 14 or the second human-machine interface 24. Besides, during raising the carrying structure 180, the electrical adjustable apparatus 1 can continually retrieve the tilted angle or acceleration from the portable device 1100 for determining whether the carrying structure 180 tilts or has collision, and automatically perform the anti-crash mechanism when determining that the carrying structure 180 tilts or has collision.

As the skilled person will appreciate, various changes and modifications can be made to the described embodiment. It is intended to include all such variations, modifications and equivalents which fall within the scope of the present disclosed example, as defined in the accompanying claims.

What is claimed is:

1. A portable device for controlling an external electrical adjustable apparatus, comprising:

a case;

a signal transmitter installed in the case and connected to the electrical adjustable apparatus;

a tilt sensor sensing a tilted angle and sensing a raising/lowering-controlling operation of moving or rotating the portable device;

a memory storing a threshold angle; and a processor installed in the case and electrically connected to the signal transmitter, the tilt sensor and the memory, the processor being configured to generate a raising/lowering-controlling signal according to the raising/lowering-controlling operation, and transmitting the raising/lowering-controlling signal by the signal transmitter to the external electrical adjustable apparatus for making the external electrical adjustable apparatus raise/lower according to the raising/lowering-controlling signal, the processor being configured to determine that a carrying structure of the electrical adjustable apparatus has collision when receiving any raising/lowering-controlling signal used to control the electrical adjustable apparatus and the tilted angle is not less than the threshold angle, and sending a stopping signal to the electrical adjustable apparatus via the signal transmitter for making the electrical adjustable apparatus stop raising/lowering the carrying structure.

2. The portable device for controlling the external electrical adjustable apparatus according to claim 1, wherein the threshold angle is 0.3 degrees.

3. The portable device for controlling the external electrical adjustable apparatus according to claim 1, wherein the signal transmitter is Bluetooth transmitter, Wi-Fi transmitter or ZigBee transmitter.

4. The portable device for controlling the external electrical adjustable apparatus according to claim 1, wherein the tilt sensor is gyroscope or accelerometer.

5. The portable device for controlling the external electrical adjustable apparatus according to claim 1, wherein the portable device further comprises a human-machine interface electrically connected to the processor, the human-machine interface is used to receive operation and trigger the raising/lowering-controlling signal.

6. The portable device for controlling the external electrical adjustable apparatus according to claim 5, wherein the processor generates the raising/lowering-controlling signal after the human-machine interface receives a control-preceding operation and the tilt sensor receives the raising/lowering-controlling operation.

7. The portable device for controlling the external electrical adjustable apparatus according to claim 6, wherein the control-preceding operation is an operation of pressing a designated button of the human-machine interface, an operation of touching a designated position of a touchscreen of human-machine interface down, inputting a password by the human-machine interface, unlocking a screen lock of the portable device or moving the portable device in a designated way.

8. The portable device for controlling the external electrical adjustable apparatus according to claim 5, wherein the portable device further comprises a standby unit installed in the case and electrically connected to the human-machine interface and the processor, the standby unit forwards the raising/lowering-controlling signal received from the human-machine interface to the processor, and keeps a path between the human-machine interface and the processor conductive for a standby time when failing to receive the raising/lowering-controlling signal.

9. The portable device for controlling the external electrical adjustable apparatus according to claim 8, wherein the standby unit is optical coupler.

10. The portable device for controlling the external electrical adjustable apparatus according to claim 1, wherein the portable device is smart glasses, smart watch, tablet, smart wristband or smart ring.

11. The portable device for controlling the external electrical adjustable apparatus according to claim 1, wherein the processor generates the raising/lowering-controlling signal used to control the electrical adjustable apparatus to raise if the tilt sensor senses the raising/lowering-controlling operation of horizontally moving the portable device in a first horizontal moving direction.

12. The portable device for controlling the external electrical adjustable apparatus according to claim 11, wherein the processor generates the raising/lowering-controlling signal used to control the electrical adjustable apparatus to lower if the tilt sensor senses the raising/lowering-controlling operation of horizontally moving the portable device in a second horizontal moving direction being opposite to the first horizontal moving direction.

13. The portable device for controlling the external electrical adjustable apparatus according to claim 1, wherein the processor generates the raising/lowering-controlling signal used to control the electrical adjustable apparatus to increase a stretching/shortening speed if the tilt sensor senses the raising/lowering-controlling operation of horizontally rotating the portable device in a first horizontal rotating direction.

14. The portable device for controlling the external electrical adjustable apparatus according to claim 13, wherein the processor generates the raising/lowering-controlling signal used to control the electrical adjustable apparatus to reduce the stretching/shortening speed if the tilt sensor senses the raising/lowering-controlling operation of horizontally rotating the portable device in a second horizontal rotating direction being opposite to the first horizontal rotating direction.

* * * * *